US009841217B2

(12) United States Patent
Lee et al.

(10) Patent No.: US 9,841,217 B2
(45) Date of Patent: Dec. 12, 2017

(54) ICE MAKING DEVICE, REFRIGERATOR INCLUDING ICE MAKING DEVICE, AND METHOD OF CONTROLLING REFRIGERATOR

(71) Applicant: LG ELECTRONICS INC., Seoul (KR)

(72) Inventors: Donghoon Lee, Seoul (KR); Seojin Lee, Seoul (KR); Wookyong Lee, Seoul (KR); Bongjin Kim, Seoul (KR); Seungyoon Cho, Seoul (KR); Seungseob Yeom, Seoul (KR)

(73) Assignee: LG Electronics Inc., Seoul (KR)

( * ) Notice: Subject to any disclaimer, the term of this patent is extended or adjusted under 35 U.S.C. 154(b) by 324 days.

(21) Appl. No.: 14/630,260

(22) Filed: Feb. 24, 2015

(65) Prior Publication Data

US 2015/0241102 A1 Aug. 27, 2015

(30) Foreign Application Priority Data

Feb. 24, 2014 (KR) ..... 10-2014-0021056
Feb. 25, 2014 (KR) ..... 10-2014-0021848

(51) Int. Cl.
*F25C 1/10* (2006.01)
*F25C 1/24* (2006.01)
(Continued)

(52) U.S. Cl.
CPC ..... *F25C 1/10* (2013.01); *F25C 1/225* (2013.01); *F25C 1/24* (2013.01); *F25C 5/005* (2013.01);
(Continued)

(58) Field of Classification Search
CPC ... F25C 2400/14; F25C 1/10; F25C 2305/022
See application file for complete search history.

(56) References Cited

U.S. PATENT DOCUMENTS 3,411,554 A * 11/1968 Wilson ..... F25C 1/225 141/351
4,265,089 A * 5/1981 Webb ..... F25C 1/04 280/801.2
(Continued)

FOREIGN PATENT DOCUMENTS

EP 1519130 3/2005
EP 1798500 6/2007
(Continued)

OTHER PUBLICATIONS

Extended European Search Report issued in European Application No. 15156429.1 on Nov. 20, 2015, 10 pages.

*Primary Examiner* — Cassey D Bauer
(74) *Attorney, Agent, or Firm* — Fish & Richardson P.C.

(57) ABSTRACT

A refrigerator includes a main body defining a storage compartment, a door, an ice making device, a water tank disposed for supplying water into the ice making device, and an ice bin to receive and store ice pieces made in the ice making device. The ice making device includes an ice making tray having ice making chambers configured to be filled with water for making the ice pieces, and an ejector extending from an upper central portion of the ice making tray in a longitudinal direction of the ice making tray to pass through both ends of the ice making tray. The ejector is configured to be maintained in a fixed state during water supply, ice making, and ice separation processes, and the ice making tray is configured to rotate at an angle of about 360° in one direction with respect to the ejector.

19 Claims, 16 Drawing Sheets

(51) Int. Cl.

| | |
|---|---|
| ***F25C 5/00*** | (2006.01) |
| ***F25D 23/04*** | (2006.01) |
| ***F25D 23/12*** | (2006.01) |
| ***F25C 1/22*** | (2006.01) |

(52) U.S. Cl.
CPC ..... *F25D 23/04* (2013.01); *F25D 23/126* (2013.01); *F25C 2305/022* (2013.01); *F25C 2400/10* (2013.01); *F25C 2400/14* (2013.01); *F25C 2700/12* (2013.01); *F25C 2700/14* (2013.01); *F25D 2323/122* (2013.01)

(56) References Cited

U.S. PATENT DOCUMENTS

| | | | | |
|---|---|---|---|---|
| 5,992,167 | A | 11/1999 | Hill et al. | |
| 6,112,540 | A * | 9/2000 | Serrels | F25C 1/04 62/351 |
| 2011/0011116 | A1* | 1/2011 | Kim | F25C 1/04 62/347 |
| 2012/0318003 | A1* | 12/2012 | Kim | F25C 1/04 62/71 |

FOREIGN PATENT DOCUMENTS

| | | | |
|---|---|---|---|
| JP | S49-122049 | | 11/1974 |
| JP | H11-83278 | | 3/1999 |
| KR | 10-20100-002901 | A | 1/2010 |
| KR | 10-2010-0061492 | A | 6/2010 |
| KR | 10-2011-0016092 | A | 2/2011 |
| KR | 10-2011-0072367 | A | 6/2011 |
| WO | 2008/030020 | | 3/2008 |
| WO | 2011/155801 | | 12/2011 |

* cited by examiner

ICE MAKING DEVICE, REFRIGERATOR INCLUDING ICE MAKING DEVICE, AND METHOD OF CONTROLLING REFRIGERATOR

CROSS-REFERENCE TO RELATED APPLICATIONS

The present application claims priority under 35 U.S.C. 119 and 35 U.S.C. 365 to Korean Patent Application No. 10-2014-0021056 filed on Feb. 24, 2014 and Korean Patent Application No. 10-2014-0021848 filed on Feb. 25, 2014, which are hereby incorporated by reference in their entirety.

TECHNICAL FIELD

The present disclosure relates to a refrigerator and a control method thereof.

BACKGROUND

Generally, refrigerators are home appliances for storing foods at a low temperature. In some cases, refrigerators can include a water supply container in a refrigerating compartment, an ice maker for making an ice piece in a freezing compartment, and a pump for forcibly supplying water within the water supply container to the ice maker. In some cases, refrigerators can include an ice making tray having a plurality of cells, an ejector for ejecting an ice piece in the cell, a driving motor for driving the ejector, and a heater for heating the ice making tray. In some cases, refrigerators can include an ice maker and an ice bin on a refrigerating compartment door, where the ice maker is connected to a motor assembly to separate an ice piece in a twisting manner.

SUMMARY

According to one aspect, a refrigerator includes a main body defining a storage compartment, a door configured to open and close at least a portion of the storage compartment, an ice making device disposed in the storage compartment or on a back surface of the door, a water tank disposed above the ice making device and configured to supply water for making ice pieces into the ice making device, and an ice bin disposed under the ice making device to receive and store ice pieces made in the ice making device. The ice making device includes an ice making tray having a plurality of ice making chambers that are configured to be filled with water for making the ice pieces, and an ejector extending from an upper central portion of the ice making tray in a longitudinal direction of the ice making tray to pass through both ends of the ice making tray. The ejector is configured to be maintained in a fixed state during water supply, ice making, and ice separation processes, and the ice making tray is configured to rotate at an angle of about 360° in one direction with respect to the ejector.

Implementations according to this aspect may include one or more of the following features. For example, the ejector may include a fixing shaft passing through both ends of the ice making tray, and a plurality of arms that radially extend from an outer circumferential surface of the fixing shaft, wherein, based on the ice making tray rotating, the plurality of arms are configured to press the ice pieces generated in the ice making chambers to eject the ice pieces from the ice making tray. The plurality of arms may be spirally disposed to be spaced a predetermined distance from each other on the outer circumferential surface of the fixing shaft in a longitudinal direction so that the ice pieces made in the ice making chambers are successively separated by a corresponding time difference. Each of the plurality of arms may be configured to press an edge of a top surface of each of the ice pieces generated in the ice making chambers, to thereby eject the ice pieces from the ice making chamber, and the edge of the top surface of each of the ice pieces being pressed by the arm may have a width less than that of an opposite edge of the top surface of each of the ice pieces. The water tank may include a water discharge hole defined in a bottom surface thereof, and a valve configured to open and close the water discharge hole. The ice making tray may further include a first rotation shaft extending from one side surface thereof, and a second rotation shaft extending from the other side surface opposite to the one side surface.

According to this aspect, the refrigerator may further include a driving unit connected to the first rotation shaft, a valve operation unit fitted into an outer circumferential surface of the second rotation shaft to integrally rotate with the ice making tray, and an operation member having a first end that is in contact with an outer circumferential surface of the valve operation unit and a second end that is connected to the valve, the operation member being configured to convert a rotation force of the valve operation unit into linear reciprocating movement to operate the valve. The valve operation unit may have one side having a cam shape protruding in a radial direction to elevate the operation member when the cam rotates. The driving unit may include an alternating current (AC) motor configured to rotate in at least one direction, and a power transmission unit configured to transmit a rotation force of the AC motor to the ice making tray, wherein the power transmission unit includes a gear assembly. The refrigerator may further include a tray support for supporting the ice making tray, wherein the tray support includes a shaft coupling unit horizontally protruding from one surface thereof to support the second rotation shaft, and a movement guide extending upward from the other surface thereof to surround at least a portion of the operation member and to thereby guide movement of the operation member. The fixing shaft may have one end that passes through the second rotation shaft and fixedly supported by the shaft coupling unit, and the second rotation shaft may be rotatably supported by the shaft coupling unit. The refrigerator may further include a tank support configured to support the water tank, wherein the tank support includes a through-hole through which the movement guide passes, and a water guide unit configured to guide the water discharged from the water discharge hole into the ice making tray. The refrigerator may further include a heater mounted on the tank support.

Also under this aspect, the storage compartment may include a freezing compartment, and the door may include a freezing compartment door. The ice making device and the water tank may be disposed on the freezing compartment door, and the refrigerator may further include a heat insulation box disposed on a back surface of the freezing compartment door to accommodate the water tank therein. The water tank may be disposed on an outer top surface of the main body, the ice making device may be disposed in the freezing compartment, and the water discharged from the water tank may pass through the main body to be supplied into the ice making device. The refrigerator may further include a temperature sensor mounted on a surface of the ice making tray to detect a temperature of the ice making tray, electrodes electrically connected to the temperature sensor, the electrodes being disposed on a side surface of the ice making tray facing the tray support, contact points disposed on the tray support and configured to electrically contact the electrode, and a controller electrically connected to the contact point and configured to receive the temperature value of the ice making tray. Each of the electrodes may be disposed on an end of the valve operation unit that is in contact with the tray support, and each of the contact points may be disposed on a circumference corresponding to a rotation trace of the electrode. The contact points may be disposed on one or a plurality of points along the circumference. Each of the contact points may have an arc shape having a predetermined length along the circumference. Each of the contact points may have a circular shape over an entirety of the circumference. The electrodes may include a first electrode, and a second electrode disposed at a position that is radially spaced apart from the first electrode, wherein the contact points include a first contact point corresponding to the first electrode, and a second contact point corresponding to the second electrode. The refrigerator may further include a heater mounted on the water tank, the heater being configured to be controlled in on/off operation by the controller based on the temperature value detected by the temperature sensor.

According to another aspect, a method, which is for controlling a refrigerator including a main body having a storage compartment, a door configured to open and close at least a portion of the storage compartment, an ice making device disposed in the storage compartment or on a back surface of the door, a water tank disposed above the ice making device to supply water for making ice pieces into the ice making device, and an ice bin disposed under the ice making device to receive and store ice pieces made in the ice making device, wherein the ice making device includes an ice making tray having a plurality of ice making chambers that are configured to be filled with water for making the ice pieces, and an ejector extending from an upper central portion of the ice making tray in a longitudinal direction of the ice making tray to pass through both ends of the ice making tray, may include maintaining the ejector in a fixed state, performing water supply, ice making, and ice separation processes, and while the ice making tray successively performs water supply, ice making, and ice separation processes, rotating the ice making tray 360° in one direction with respect to the ejector.

Implementations according to this aspect may include one or more of the following features. For example, the water supply process may include rotating the ice making tray to a first position where the water is supplied into the ice making tray, maintaining the ice making tray in the first position until water is filled by a predetermined amount into the ice making tray, rotating the ice making tray from the first position to a second position where the water supplied into the ice making tray is distributed into the plurality of ice making chambers, and maintaining the ice making tray in the second position to enable freezing of the ice pieces to start. The method may further include detecting a temperature of the ice making tray by using a temperature sensor mounted on the ice making tray after the water supply process is performed, and controlling, by a controller, an on/off operation of a heater mounted on the water tank depending on a temperature value detected by the temperature sensor. Based on the water supply process being completed, and based on determining that the temperature value detected by the temperature sensor reaches a preset temperature, the heater may be allowed to be maintained in an on state. Based on the water supply process being completed, and based on determining that the temperature value detected by the temperature sensor does not reach the preset temperature, the water supply process may be allowed to be repeatedly performed. Based on the water supply process being repeatedly performed, and based on determining that the temperature value detected by the temperature sensor does not reach the preset temperature, the heater may be turned off. Generating, by the controller, a water replenishing signal at the same time as or after turning off operation of the heater. The method may include generating, by the controller, a water replenishing signal at the same time as or after turning off operation of the heater.

The details of one or more implementations are set forth in the accompanying drawings and the description below. Other features will be apparent from the description and drawings, and from the claims.

DETAILED DESCRIPTION

Reference will now be made in detail to the implementations of the present disclosure, examples of which are illustrated in the accompanying drawings.

Figure 1:
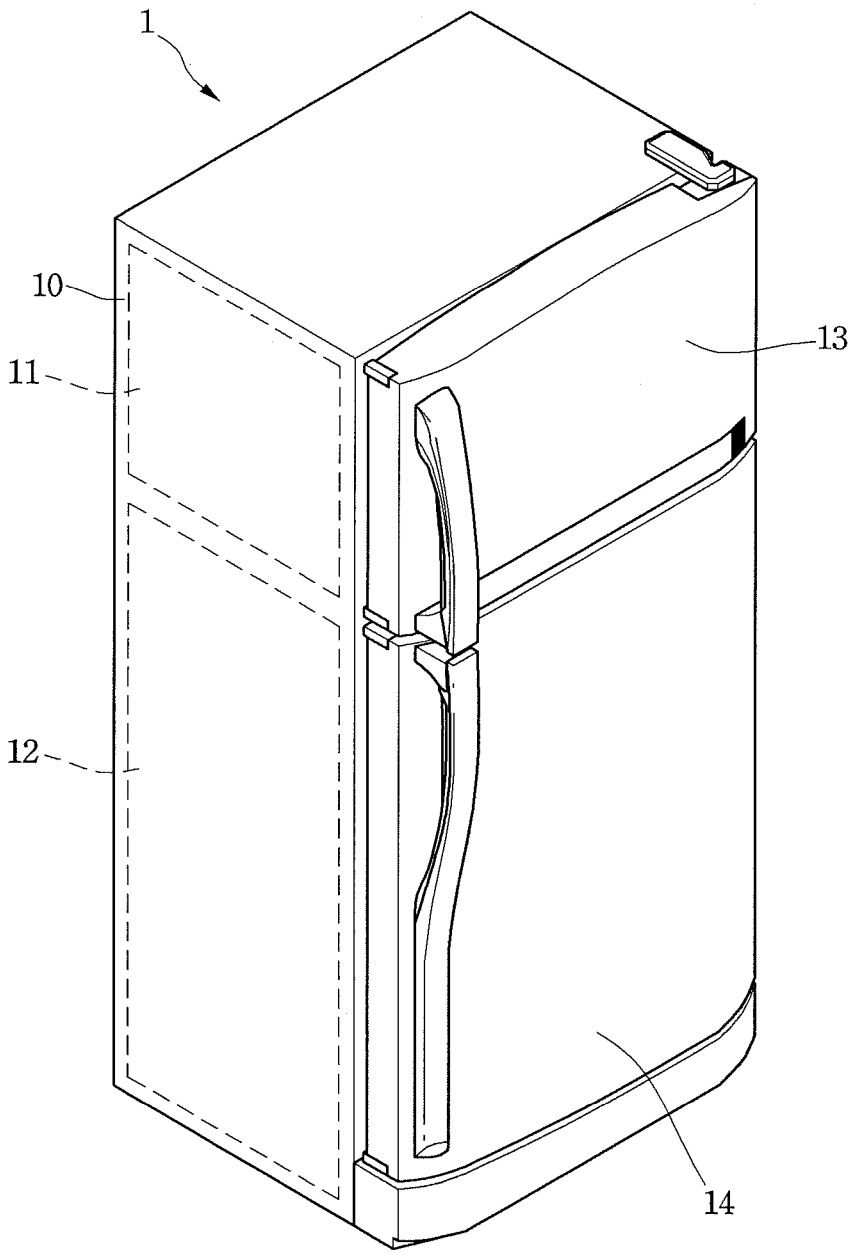
FIG. 1 is a perspective view showing an example refrigerator according to a first implementation.
Figure 2:
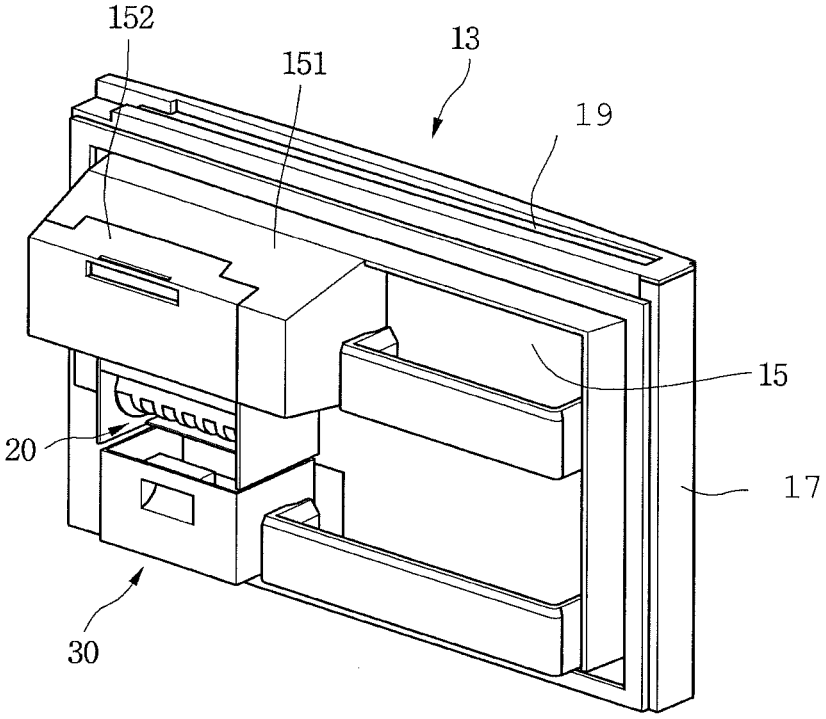
FIG. 2 is a perspective view of a freezing compartment door according to the first implementation.

Referring to FIGS. 1 and 2, a refrigerator 1 according to a first implementation may include a main body 10 including a freezing compartment 11 and a refrigerating compartment 12 disposed under the freezing compartment 11, a freezing compartment door 13 connected to the main body 10 to open and close the freezing compartment 11, and a refrigerating compartment door 14 connected to the main body 10 to open and close the refrigerating compartment 12. In the current implementation, the freezing compartment 11 and the refrigerating compartment 12 are commonly called a storage compartment, and the freezing compartment door 13 and the refrigerating compartment door 14 are commonly called a refrigerator door.

The freezing compartment door 13 may include an outer case 17 defining an outer appearance, a door liner 15 for covering the freezing compartment 11, and a décor member 19 connecting the door liner 15 to the outer case 17.

An ice making assembly for generating and storing ice pieces may be disposed on the door liner 15. The ice making assembly may include an ice making device 20 for generating the ice pieces and an ice bin 30 for storing the ice pieces generated in the ice making device 20.

Also, a heat insulation box 151 may be disposed on a back surface of the freezing compartment door 13. The heat insulation box 151 may be defined as a unit of the door liner 15. Also, the heat insulation box 151 may define a space for accommodating a water tank (see reference numeral 40 of FIG. 3) in which water for making ice pieces is stored.

Also, a box cover 152 may open and close an inner space of the heat insulation box 151. A heat insulation material may be further provided in a space defined by the heat insulation box 151 and the box cover 152.

Also, the box cover 152 may be separated from the heat insulation box 151 to install the water tank 40 into the heat insulation box 151 or to separate the water tank 4 from the heat insulation box 151.

In the current implementation, since the water tank 40 is disposed in the heat insulation box 151, a phenomenon in which the water tank 40 is frozen by chill air of the freezing compartment may be prevented even though the water tank 40 is disposed in the freezing compartment door 13.

Figure 3:
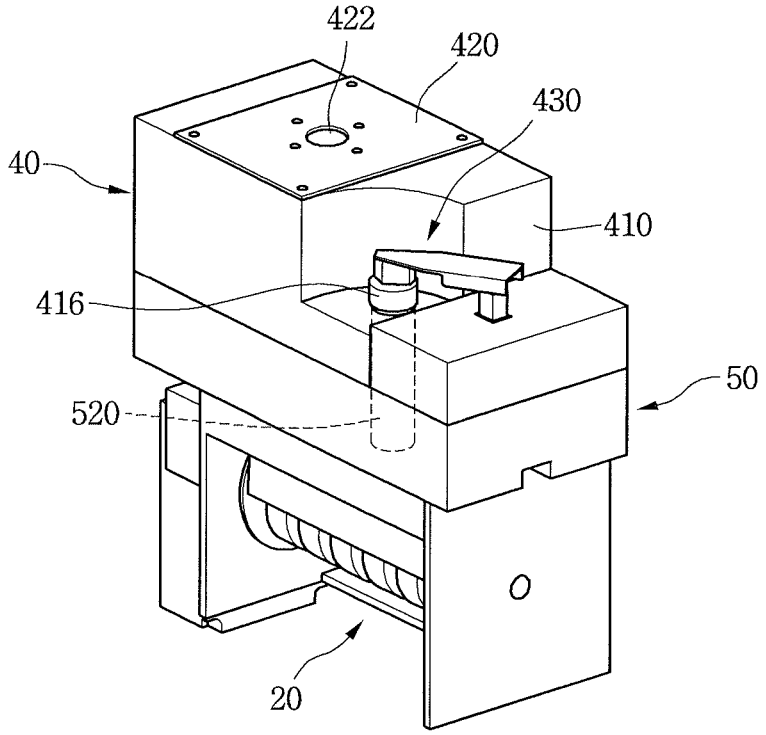
FIG. 3 is a perspective view showing an example arrangement of a water tank and an ice making device according to the first implementation.
Figure 4:
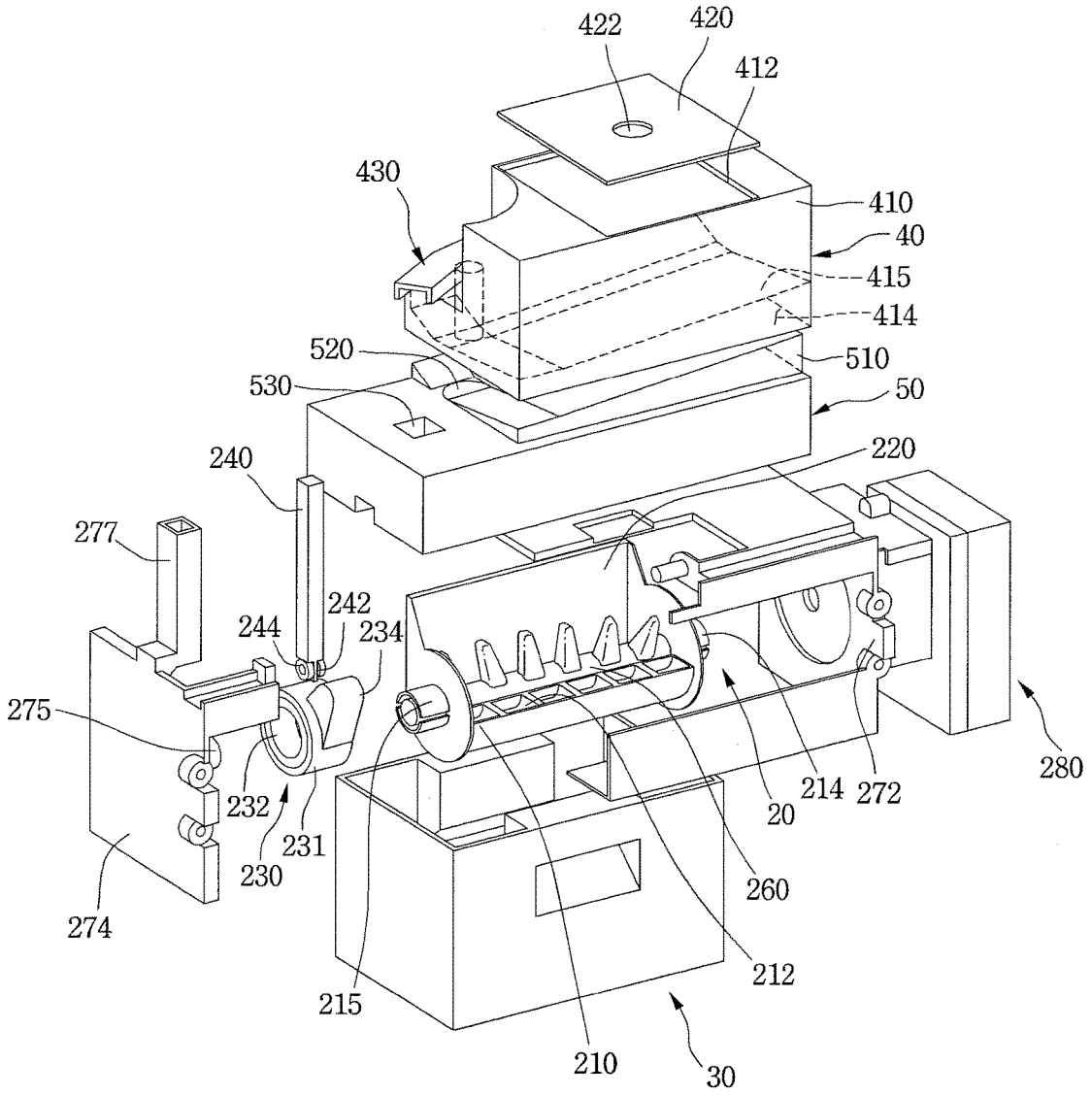
FIG. 4 is an exploded perspective view showing an example ice making assembly according to the first implementation.

Referring to FIGS. 2 to 4, the water tank 40 according to the first implementation may be disposed directly above the ice making device 20.

A tank support 50 for supporting the water tank 40 may be disposed in the heat insulation box 151. The water tank 40 may be separably seated on a top surface of the tank support 50.

The water tank 40 may include a tank body 410 defining a space in which water is stored and a tank cover 420 for opening and closing the tank body 410.

An opening 412 may be defined in the tank body 410. The tank cover 420 may open and close the opening 412. The tank cover 420 may be separably or rotatably coupled to the tank body 410.

A user may separate the water tank 40 from the freezing compartment door 13 and open the opening 412 to supply the water into the tank body 410. Also, the user may clean inside the tank body 410 in a state where the opening 412 is opened.

A hole 422 through which air flows may be defined in the tank cover 420. The user may supply the water into the tank body 410 through the hole 422 without separating the tank cover 420 from the tank body 410.

A seating guide 510 may inclinedly protrude from a top surface of the tank support 50. An accommodation 414 into which the seating guide 510 is accommodated may be defined in a lower portion of the tank body 410. The seating guide 510 may be accommodated into the accommodation unit 414 to prevent a phenomenon in which the water tank 40 horizontally oscillates while the freezing compartment door 13 is opened or closed. The user may lift the water tank 40 to separate the water tank 40 from the tank support 50.

A lower wall 415 of the tank body 410 may be inclined downward to correspond to a shape of the seating guide 510. Also, a water discharge hole (see reference numeral 418 of FIG. 8) for discharging the water may be defined in a spot of the lower wall 415, which corresponds to the lowest portion of the lower wall 415. Also, the tank body 410 includes a valve assembly 430 for opening and closing the water discharge hole 418. An operation of the valve assembly 430 will be described below with reference to the accompanying drawings.

The tank support 50 may be coupled to the heat insulation box 151 or integrated with the heat insulation box 151.

A water guide hole 520 for guiding the water discharged from the water discharge hole 418 to the ice making device 20 may be defined in the top surface of the tank support 50. To prevent the water discharged from the water discharge hole 418 from leaking into a space between the top surface of the tank support 50 and a bottom surface of the water tank 40, a portion of the water discharge hole 418 may be inserted into the water guide hole 520.

The ice making device 20 may include an ice making tray 210 including a plurality of ice making chambers 212 for generating ice pieces, a driving unit 280 for rotating the ice making tray 210, and valve operation units 230 and 240 transmitting rotational force of the ice making tray 210 to the valve assembly 430 to operate the valve assembly 430.

The ice making tray 210 may include a water supply guide 220 for guiding the water supplied from the water tank 40 to the plurality of ice making chambers 212. The water supply guide 220 may extend upward from a top surface of the ice making tray 210.

A first rotation shaft 214 and a second rotation shaft 215 which are rotational centers of the ice making tray 210 may be disposed on both side surfaces of the ice making tray 210. The rotation shafts 214 and 215 may be respectively rotatably supported by tray supports that are disposed at both sides of the ice making tray 210.

The tray supports 272 and 274 may include a first support 272 and a second support 274. In detail, the first rotation shaft 214 disposed on one side of the ice making tray 210 may pass through the first support 272. Also, the second rotation shaft 215 disposed on the other side of the ice making tray 210 may be coupled to the second support 274.

The driving unit 280 may be coupled to the first support 272. In some cases, the driving unit 280 may include an AC motor that is rotatable in one direction and a power transmission unit for transmitting power of the AC motor to the first rotation shaft 214 of the ice making tray 210. For example, the power transmission unit may be a gear, but not be limited thereto.

In the current implementation, the AC motor that is relatively inexpensive in comparison to a bidirectionally rotatable DC motor may be adapted to reduce manufacturing costs of the refrigerator.

The first rotation shaft 214 may pass through the first support 272 and thus be connected to the driving unit 280. For another example, a portion of the power transmission unit or a shaft of the AC motor, which constitute the driving unit 280, may pass through the first support 272 and thus be coupled to the first rotation shaft 214 of the ice making tray 210.

A shaft coupling unit 275 inserted into the second rotation shaft 215 may protrude from the second support 274. The second coupling unit 275 may support the second rotation shaft 215 and also guide rotation of the second rotation shaft 215.

The valve operation units 230 and 240 may include a cam 230 coupled to the second rotation shaft 215 and an operation member 240 linearly reciprocating in a vertical direction in a state where the operation member 240 is in contact with an outer circumferential surface of the cam 230.

The cam 230 may be coupled to the second rotation shaft 215 to integrally rotate with the second rotation shaft 215. The cam 230 may include a cylindrical cam body 231 having a shaft coupling hole 232 and a protrusion 234 protruding from the outer circumferential surface of the cam body 231.

The second rotation shaft 215 may be rotatably connected to the shaft coupling unit 275 in a state where the second rotation shaft 215 is inserted into the shaft coupling hole 232. For example, the second rotation shaft 215 may be rotatably inserted into the shaft coupling unit 275. On the contrary, the shaft coupling unit 275 may be rotatably inserted into the second rotation shaft 215.

The operation member 240 may have a transversal section having a non-circular shape. For example, the operation member 240 may have a column or oval column shape having a polygonal section and have any shape having a non-circular section. The operation member 240 may contact a circumference of the cam body 231 and the protrusion 234 when the cam 230 rotates.

In detail, one or more rollers 244 may be disposed on a lower end of the operation member 240 to prevent a contact surface between the operation member 240 and the cam 230 from being damaged and to smoothly transmit rotation force of the cam 230 to the operation member 240. Also, a roller coupling unit 242 to which the one or more rollers 244 are mounted is disposed on the lower end of the operation member 240. Thus, the one or more rollers 244 of the operation member 240 may substantially contact the cam 230.

The protrusion 234 may have a round or inclined shape so that the operation member 240 linearly moves by receiving the rotation force of the cam 230.

A movement guide 277 for guiding linear movement of the operation member 240 in a vertical direction may extend from the second support 274. Also, the operation member 240 may be inserted into the movement guide 277. Alternatively, the movement guide 277 may surround a portion of the operation member 240. Thus, a portion or whole of a horizontal section of the movement guide 277 may be the same as that of a horizontal section of the operation member 240.

The operation member 240 may ascend by the rotation of the cam 230 to operate the valve assembly 430 when the ice making tray 210 rotates in one direction to separate the ice pieces therefrom.

A through-hole 530 through which the movement guide 277 and the operation member 240 pass may be defined in the tank support 50. A portion or whole of a horizontal section of the through-hole 530 may be the same as that of a horizontal section of the movement guide 277. Also, since each of the movement guide 277 and the operation member 240 has the non-circular horizontal section, a phenomenon in which the operation member 240 idly rotates about a vertical axis passing through a center thereof while the operation member 240 vertically linearly moves may be prevented. Thus, the operation member 240 may stably transmit the rotation force of the ice making tray 210 to the valve assembly 430.

The ice making assembly may further include an ejector 260 for separating each of the ice pieces generated in each of the ice making chambers 212 from the ice making tray 210 while the ice making tray 210 rotates. The ejector 260 may be disposed at an upper side of the ice making tray 210. Also, the ejector 260 may have one end that is relatively rotatably connected to the ice making tray 210 and the other end that passes through the second rotation shaft 215 and is inserted into the shaft coupling unit 275. That is, the one end of the ejector 260 may be idly coupled to a side surface of the ice making tray 210. Thus, the ejector 260 may be maintained in a stopped state when the ice making tray 210 rotates. Thus, according to the current implementation, the driving unit 280 may not be provided to rotate the ejector 260 but be provided to rotate the ice making tray 210. This is a difference between the current implementation and the ice making device according to the related art in which the ejector rotates.

Figure 5:
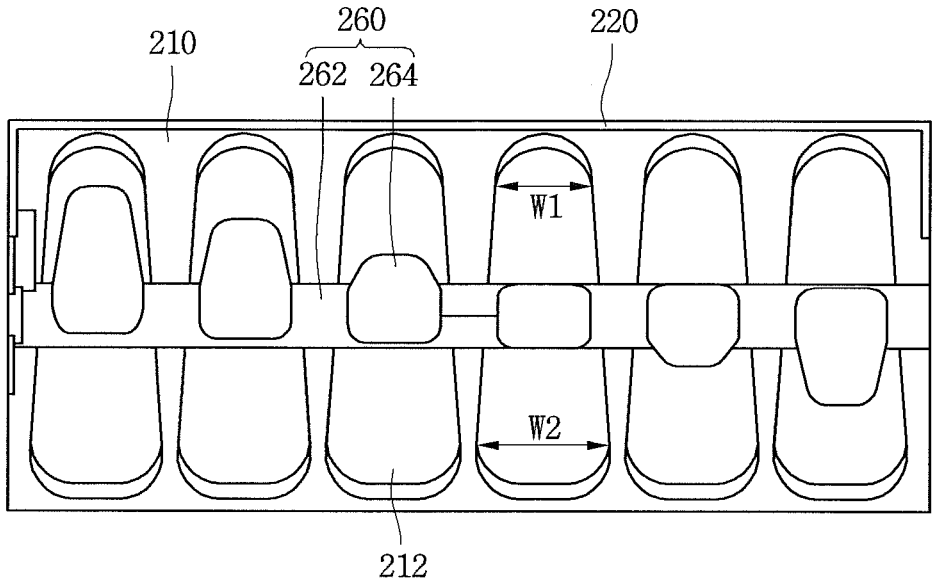
FIG. 5 is a plane view showing an example state in which an ice making tray and an ejector are disposed according to the first implementation.
Figure 6:
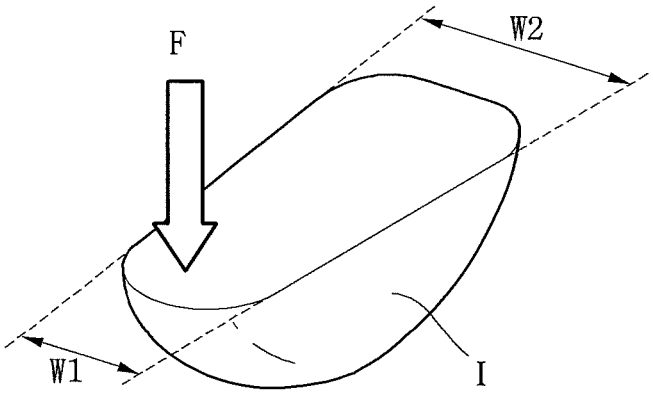
FIG. 6 is a view showing a direction of a force of the ejector applied to an ice piece generated in the ice making tray in FIG. 5.

Referring to FIGS. 5 and 6, the ice making tray 210 according to the current implementation includes a plurality of ice making chamber 212 as described above. Also, a water supply guide 220 may extend from one side of the ice making tray 210.

The ejector 260 may include a fixing shaft 262, a plurality of arms 264 radially extending from a circumference of the fixing shaft 262 to scoop up the ice pieces generated in the ice making chambers 212.

The fixing shaft 262 may extend in a longitudinal direction of the ice making tray 210. The fixing shaft 262 may be disposed at a position that coincides with a central line of the ice making tray 210 extending in the longitudinal direction of the ice making tray 210. That is, the fixing shaft 262 may be disposed on a central portion of the top surface of the ice making tray 210 and extend in the longitudinal direction of the ice making tray 210.

As illustrated in FIG. 4, the fixing shaft 262 may pass through both side surfaces of the ice making tray 210. The fixing shaft 262 may have one end that is fixedly connected to the shaft coupling unit 275 disposed on the tray support 274. Also, the fixing shaft 262 may pass through the first and second rotation shafts 214 and 215 and thus be maintained in a fixed state even though the first and second rotations shafts 214 and 215 rotate.

The ice making chamber 212 may have the one end having a width W1 that is less than that W2 of the other end thereof so that the ice piece generated in the ice making chamber 212 is easily separated by the ejector 260. That is, the ice making chamber 212 may have a width that gradually increases from the one end to the other end thereof. Thus, the ice piece generated in the ice making chamber 212 may have widths which are different from each other at one side and the other side of the ice piece.

The plurality of arms 264 may be spirally disposed along the fixing shaft 262 so that the ice pieces generated in the plurality of ice making chambers 212 are successively separated from the ice making tray 210 while the ice making tray 210 rotates.

In detail, the plurality of arms 264 may be spaced a predetermined distance apart from each other on an outer circumferential surface of the fixing shaft 262 in a longitudinal direction of the fixing shaft 262. The plurality of arms 264 may be disposed in a spiral shape to wind around the fixing shaft 262. Then, since the ice pieces generated in the plurality of ice making chambers 212 are successively separated by time difference, the ice making tray 210 may rotates with a relatively small force.

According to the current implementation, since the AC motor is used to rotate the ice making tray 210, the AC motor may provide less torque compared to the DC motor.

Thus, in the current implementation, the ice pieces generated in the plurality of ice making chambers 212 may be successively separated one by one so that the ice pieces generated in the ice making tray 210 are easily separated from the ice making tray 210 by the low torque.

Also, as illustrated in FIG. 6, to easily separate the ice piece I of the ice making chamber 212 from the ice making tray 210, each of the arms 264 may press a portion having a relatively small width of a top surface of the ice piece I by a predetermined force F when the ice making tray 210 rotates.

In detail, when the arm 264 presses the portion, which has a relatively small width, of the top surface of the ice piece I, an end of the top surface, which has a relatively large width, of the ice piece may protrude from the top surface of the ice making tray 210. Also, an end of the top surface having a relatively small width of the ice piece may move along a rounded bottom surface of the ice making chamber 212.

Also, since the ice making chamber 212 has a width that gradually increases from one end to the other end thereof, and the top surface of the ice piece having a relatively small width is pressed, when ice piece separation is started, a state in which a side surface of the ice piece contacts a side surface of the ice making chamber 212 may be released. Thus, a phenomenon in which the separation of the ice piece is interrupted by a friction force between the ice piece and the ice making tray 210 may be prevented. If the ice making chamber 212 has a uniform width like the structure of the ice making tray 210 according to the related art, the friction force may be applied between the side surface of the ice piece and the side surface of the ice making chamber 212 until the ice piece is perfectly separated from the ice making chamber 212, and thus ice piece separation efficiency may be reduced.

Also, in the current implementation, since the water in the water tank 40 may free-fall and thus be supplied into the ice making tray 210 while the ice making tray 210 rotates, a water guide passage for distributing and supplying the water into each of the plurality of ice making chambers 212 is not necessary in the ice making tray 210.

If the water guide passage is defined in the ice making tray 210, the water existing in the water guide passage may be frozen to allow the ice pieces generated in the ice making chambers that are adjacent to each other to be connected to each other, thereby acting as a factor that disturbs the ice piece separation. Also, since the ice piece in the water guide passage has to be separated so as to separate the connected ice pieces, much torque may be required. However, in the current implementation, since the water guide passage connecting the two ice making chambers that are adjacent to each other is not defined in the ice making tray, the ice piece may be separated from the ice making tray even though the AC motor generating a relatively low torque is used.

Figures 7A, 7B, 7C:
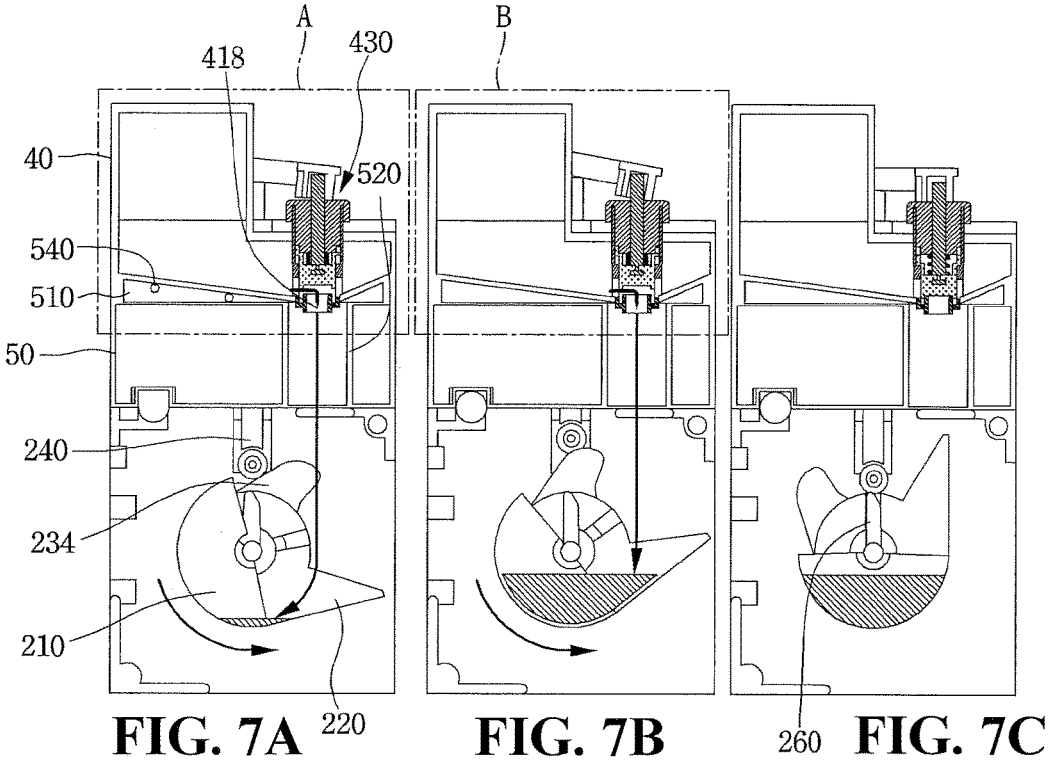
FIGS. 7A-7F are schematic views showing an example operation of an ice making assembly according to the first implementation.

FIG. 7A is a view of the ice making assembly when the water supply is started, and FIG. 7B is a view of the ice making assembly while the water is supplied. Also, FIG. 7C is the ice making assembly after the water supply is completed.

Referring to FIG. 7A, a heater 540 for heating the water tank 40 may be disposed in the tank support 50 so as to prevent the water in the water tank 40 from being frozen. In the current implementation, since the water tank 40 is disposed in the heat insulation box 151, the freezing of the water in the water tank 40 may be minimized. Also, the freezing of the water in the water tank 40 may be prevented by the heater 540.

In detail, supply of the water for making the ice pieces may be started in a state where the ice making tray 210 rotates in a predetermined angle as illustrated in FIG. 7A. That is, the supply of the water may be started in a state where a water supply guide 220 inclinedly rotates. Then, the water stored in the water tank 40 may be discharged to the outside through the valve assembly 430. The water discharged from the valve assembly 430 may fall into the water supply guide 220. Here, since the water supply guide 220 is in the inclined state, the supplied water may be uniformly supplied to the plurality of ice making chambers 212 without a separate water guide passage. Also, the ice making tray 210 may gradually rotate in a direction in which the water supply guide 220 is in an upright state while the water is supplied to prevent the supplied water from flowing down to the outside. Also, when the water is completely supplied, an angle formed between the water supply guide 220 and a horizontal plane may be about 45°, however, it is not limited thereto. That is, a predetermined angle less than about 90°, at which water does not flow down from the ice making tray 210, may be set.

Also, when the water is completely supplied, the first ice making tray 210 rotates so that the water supply guide 220 is perpendicular to the horizontal plane. The ice making may be started in the state where the water supply guide 220 is perpendicular to the horizontal plane.

Figures 7D, 7E, 7F:
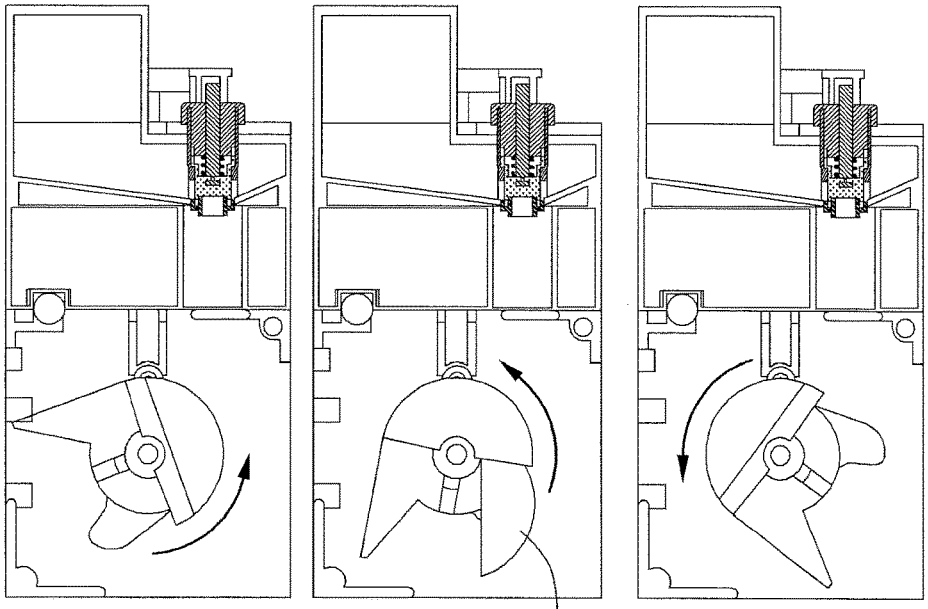

FIG. 7D is a view of the ice making assembly when the ice separation is started, and FIG. 7*e* is a view of the ice making assembly while the ice separation is performed. Also, FIG. 7F is a view of the ice making assembly when the ice separation is completed.

As illustrated, when the ice making is completed, the ice making tray 210 may start to rotate in the same direction as that in which the ice making tray 210 rotates while the water is supplied so that the ice piece is separated from the ice making tray 210 by the ejector 260. The arm 264 of the ejector 260 may press a top surface of a rear end of the ice piece having a relatively small width to allow the ice piece to be separated from the ice making tray 210. Here, the rear end of the ice piece may represent an end at a side of the water supply guide 220.

Figure 8A:
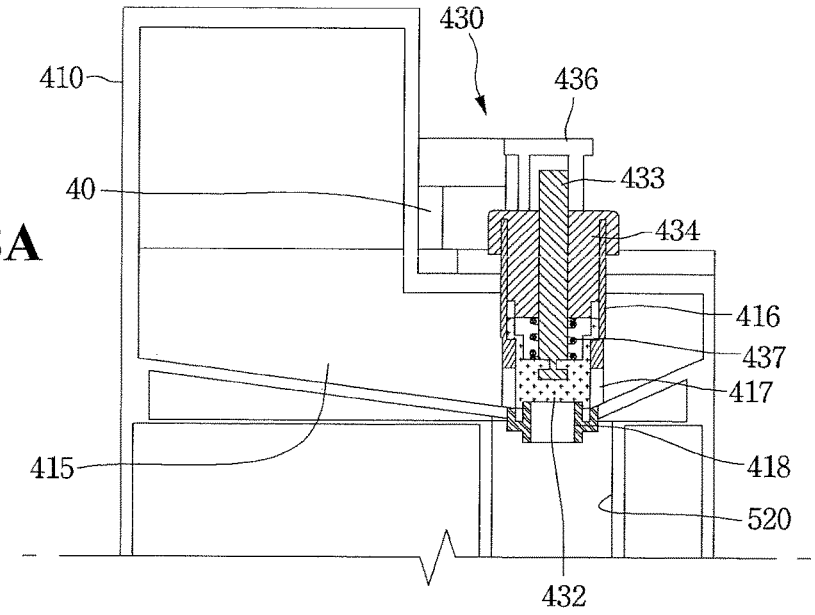
FIGS. 8A-8B are partially enlarged views showing portions A and B of FIGS. 7A and 7B.
Figure 8B:
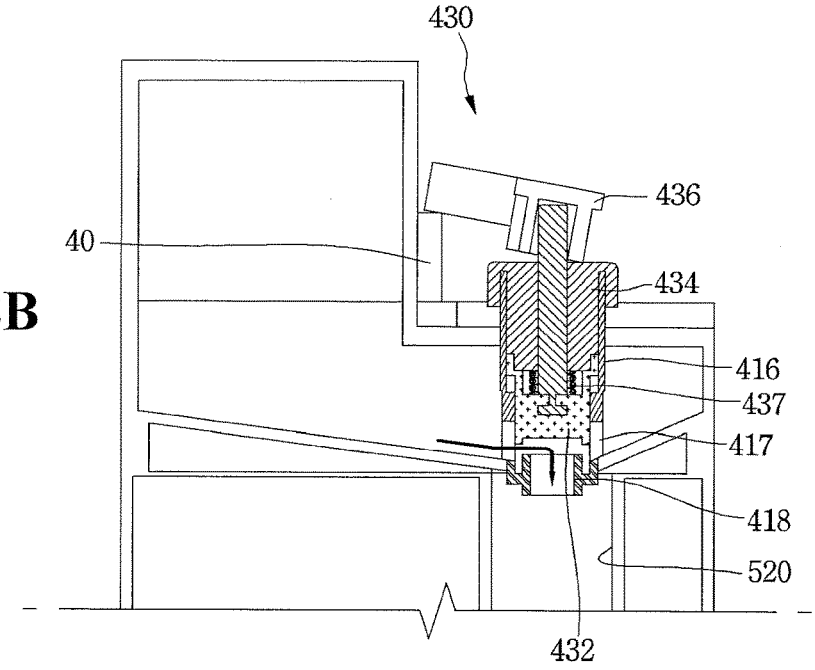

FIG. 8A is an enlarged view of portion A of FIG. 7A. FIG. 8B is an enlarged view of portion B of FIG. 7B.

First, referring to FIG. 8A, the valve assembly 430 in the current implementation may be coupled to a valve coupling part 416 disposed on the tank body 410. The valve coupling part 416 may be one end that is disposed in the tank body 410 and the other end that protrudes upward from the tank body 410. Also, a portion of the valve assembly 430 may be inserted into the valve coupling part 416.

The valve coupling part 416 may communicate with the water discharge hole 418 defined in the lower wall 415 of the tank body 410. Also, an introduction hole 417 into which the water in the tank body 410 is introduced may be defined in the valve coupling part 416. The valve assembly 430 may open and close the introduction hole 417 or the water discharge hole 418. That is, the valve assembly 430 may allow the introduction hole 417 to communicate with the water discharge hole 418 or prevent the introduction hole 417 from communicating with the water discharge hole 418.

The valve assembly 430 includes a valve body 434 inserted into the valve coupling part 416 from an upper end of the valve coupling part 416, a rod 433 passing through the valve body 434, a valve member 432 disposed on a lower end of the rod 433 to open and close the water discharge hole 418, a valve lever 436 connected to an upper end of the rod 433 to operate by the valve operation units 230 and 240, and an elastic member 437 disposed between the valve body 434 and the valve member 432 and fitted into an outer circumferential surface of the rod 433.

The valve member 432 may be a rubber packing member to simultaneously block or open the introduction hole 417 and the discharge hole 418, thereby controlling discharge of the water.

The elastic member 437 may apply a force for moving valve member 432 in a direction in which the water discharge hole 418 is closed to the valve member 432.

The valve lever 436 may receive the force from the valve operation units 230 and 240 to rotate, thereby lifting the rod 433 so that the introduction hole 417 communicates with the water discharge hole 418 through the valve member 432.

The water passing through the introduction hole 417 may flow along an outer surface of the valve member 432 and an inner surface of the valve coupling part 416 and then be discharged through the water discharge hole 418. Here, since the discharged water does not contact the elastic member 437, the elastic member 437 may be prevented from rusting, and thus the water tank may have excellent sanitation.

Referring to FIGS. 7C and 8A, during the ice making, the operation member 240 is maintained in a state where the operation member 240 contacts the cam body 231, and the valve assembly 430 is maintained in a state where the communication between the introduction hole 417 and the water discharge hole 418 is blocked.

The water supplied into the ice making chambers 212 may be cooled and frozen by the cool air of the freezing compartment 11. In some cases, a temperature sensor may be disposed on the ice making tray 210. The controller may determine whether the ice making is completed on the basis of a temperature detected by the temperature sensor.

When it is determined that the ice making is completed, the controller may operate the driving unit 280 so that the ice making tray 210 rotates in one direction.

As illustrated in FIGS. 7D and 7E, when the driving unit 280 operates, the rotation force of the motor may be transmitted to the ice making tray 210 to rotate the ice making tray 210 in a counterclockwise direction.

While the ice making tray 210 rotates in the counterclockwise direction, the ice pieces generated in the ice making chambers 212 may be successively separated by the ejector 260. While the ice making tray 210 rotates in the counterclockwise direction, the operation member 240 may contact the outer circumference of the cam body 231. However, the operation member 240 does not ascend.

As illustrated in FIG. 7F, the operation member 240 may contact the cam body 231 but not contact the protrusion 234 in a state where the ice separation is completed.

When the ice making tray 210 further rotates in the counterclockwise direction in the state where the ice separation is completed, the operation member 240 may contact the protrusion 234 as illustrated in FIG. 7A. Also, when the ice making tray 210 further rotates in the counterclockwise direction, the operation member 240 may ascend in a state where the operation member 240 contacts the protrusion 234.

When the operation member 240 ascends, the valve lever 436 is lifted as illustrated in FIG. 8B. When the valve lever 436 is lifted, the valve lever 436 may allow the rod 433 to ascend. When the rod 433 ascends, the valve member 432 connected to the rod 433 ascends to allow the introduction hole 417 to communicated with the water discharge hole 418. Thus, the water in the water tank 40 may be discharged through the water discharge hole 418. The water discharged through the water discharge hole 418 may pass through the water guide hole 520 of the tank support 50 to fall into the water supply guide 220 of the ice making tray 210.

Also, as illustrated in FIG. 7C, when the ice making tray 210 further rotates in the counterclockwise direction, the water fell into the water supply guide 220 may be distributed into each of the ice making chambers 212 of the ice making tray 210. Also, the operation member 240 may climb over the protrusion 234 of the cam 230 to descend. Here, the operation member 240 may descend by the self-weight and by the rotation force of the valve lever 436 according to a restoring force of the elastic member in the valve assembly 430.

In the state illustrated in FIG. 7C, the ice making tray 210 may be stopped, and the supply of the water may be completed.

In the current implementation, an amount of water discharged of the water discharge hole 418 or an amount of water supplied into the ice making tray 210 may vary according to time in which the introduction hole 417 communicates with the water discharge hole 418 according to the operation of the valve assembly 430.

In the current implementation, the communication time may vary according to a rotation rate of the ice making tray 210 or a length or shape of the protrusion 234 of the cam.

For example, the rotation of the ice making tray 210 may be controlled so that the ice making tray 210 has a rotation rate while the water is supplied, which is less than that of the ice making tray 210 while the ice is separated. Of course, the ice making tray 210 may be maintained at a uniform rotation rate. Or, the ice making tray may be stopped in a state where the ice making tray 210 rotates as illustrated in FIG. 7B and then rotate again after a predetermined time elapses.

That is, referring to the process illustrated in FIGS. 7A-7F, in the current implementation, when a process in which the ice piece is made in the ice making tray is called a ice making process, a water supply process in which the water in the water tank is supplied into the ice making tray, the ice making process in which the ice piece is generated in the ice making tray, and a ice separation process in which the ice piece generated in the ice making tray is separated after the ice making process is completed may be successively performed while the ice making tray rotates in one direction within a range of one revolution.

Also, the water supply process may include a first rotation process in which the ice making tray rotates to a position for receiving the water, a standby process for waiting until the water is filled in the ice making tray, and a second rotation process in which the ice making tray rotates so as to distribute the water supplied into the ice making tray to each of the ice making chambers.

Alternatively, the water supply process may be performed while the ice making tray continuously rotates.

According to the proposed current implementation, the water tank having the water discharge hole and the valve is disposed above the ice making tray, and the rotation force of the ice making tray may be transmitted to the valve by the valve operation unit to operate the valve. Thus, the water in the water tank may free fall and thus be supplied into the ice making tray without a pump and an electronic valve adjusting a flow rate.

Thus, since it is unnecessary to use a pump and an electronic valve, the refrigerator may be reduced in manufacturing costs. Also, a control program for controlling the pump and the electronic valve may not be required.

Figure 9:
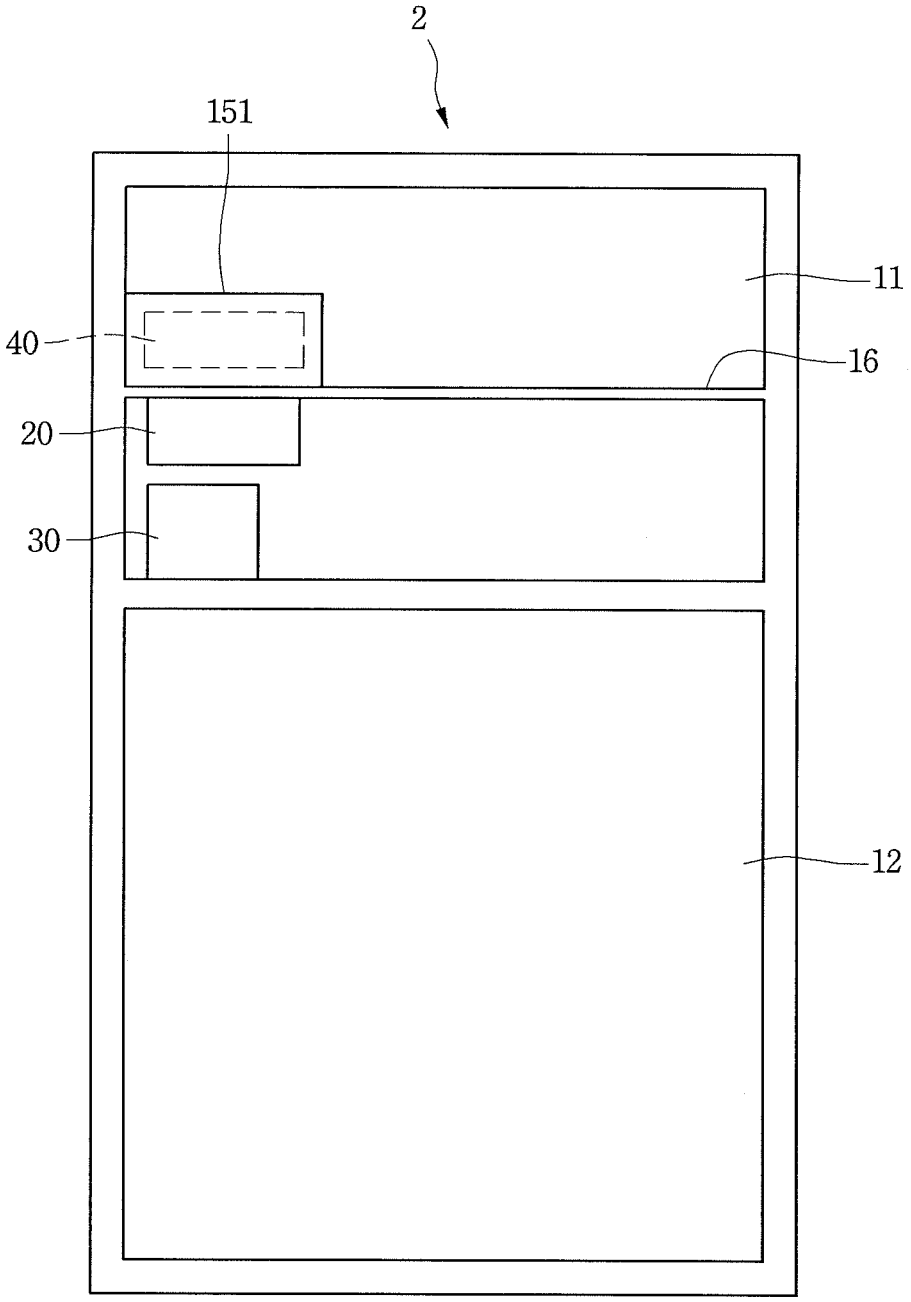
FIG. 9 is a schematic view showing an example refrigerator according to a second implementation.

FIG. 9 is a schematic view of a refrigerator according to a second implementation.

The current implementation is the same as the first implementation except for a position of an ice making assembly. Thus, only specific portions of the current implementation will be described below.

Referring to FIG. 9, a water tank 40, an ice making device 20, and an ice bin 30 may be disposed in a freezing compartment 11 in a refrigerator 2 according to the current implementation. A shelf 16 for partitioning the freezing compartment 11 into a plurality of spaces may be disposed in the freezing compartment 11. The water tank 40 may be accommodated into a heat insulation box 151 disposed on the shelf 16.

Also, the ice making device 20 and the ice bin 30 may be disposed at a lower side of the shelf 16.

Figure 10:
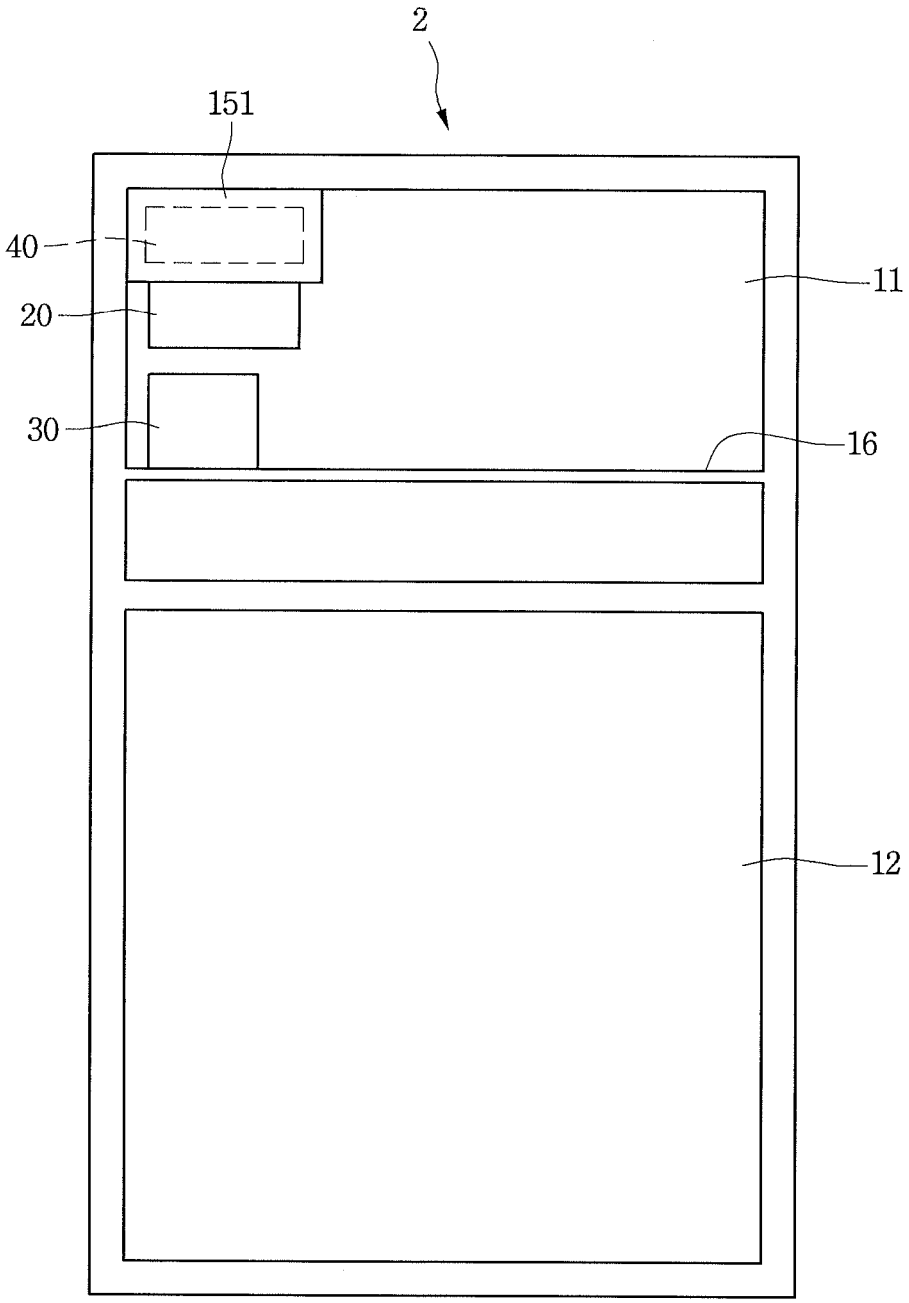
FIG. 10 is a schematic view showing an example refrigerator according to a third implementation.

FIG. 10 is a schematic view of a refrigerator according to a third implementation.

The current implementation is the same as the first implementation except for a position of an ice making assembly. Thus, only specific portions of the current implementation will be described below.

Referring to FIG. 10, in a refrigerator according to the current implementation, a heat insulation box 151 into which a water tank 40 is accommodated is disposed on a ceiling surface of the freezing compartment 11. An ice making device 20 may be disposed under the heat insulation box 151. Also, an ice bin 30 may be disposed under the ice making device 20.

A shelf 16 for partitioning the freezing compartment into a plurality of spaces may be disposed in the freezing compartment 11. The ice making device 20 may be disposed on a lower portion of the heat insulation box 151. The ice bin 30 may be seated on the shelf 16.

Figure 11:
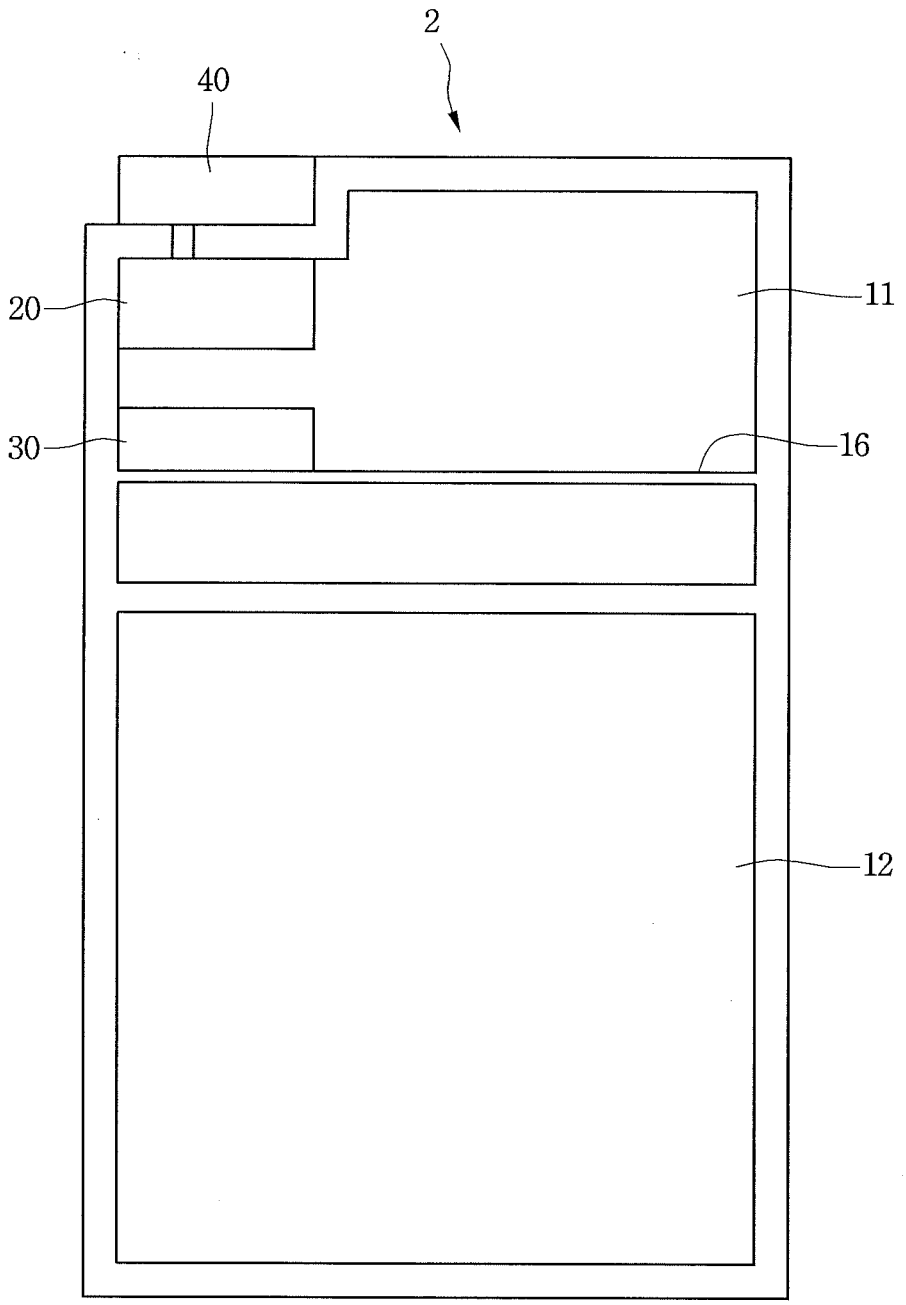
FIG. 11 is a schematic view showing an example refrigerator according to a fourth implementation.

FIG. 11 is a schematic view of a refrigerator according to a fourth implementation.

The current implementation is the same as the first implementation except for a position of an ice making assembly. Thus, only specific portions of the current implementation will be described below.

Referring to FIG. 11, in a refrigerator according to the current implementation, a water tank 40 may be disposed outside the main body 10 (see FIG. 1), and an ice making device 20 and an ice bin 30 may be disposed in a freezing compartment 11.

For example, the water tank 40 may be disposed on a top surface of the main body 10 or in a tank accommodation unit that is recessed downward from the top surface of the main body 10. Also, the water in the water tank 40 may pass through the main body 10 and thus be supplied into the ice making device 20. Of course, in this case, the water tank 40 has to be disposed directly above the ice making device 20. Also, an operation member for transmitting a rotation force of the ice making tray may pass through the main body 10 to contact a valve of the water tank 40.

In the current implementation, since the water tank 40 is disposed outside the main body, a heat insulation box is unnecessary.

For another example, according to the same principle as illustrated in FIG. 11, the water tank may be mounted on a freezing compartment door at the outside of the freezing compartment door. Also, the ice making tray and the ice bin may be disposed on a back surface of the freezing compartment door. In this case, the water tank has to be disposed directly above the ice making tray. For example, the front surface of the freezing compartment door may be recessed rearward to allow the tank accommodation unit to be defined in the freezing compartment door, and the ice making device may be disposed under the tank accommodation unit so that the water tank is disposed directly above the ice making tray. Also, the water discharged from the water tank may pass through the freezing compartment door and thus be supplied into the ice making device.

For further another example, the water tank, the ice making device, and the ice bin may be disposed in the refrigerating compartment door. That is, in some cases, a space for making ice pieces can be defined in the refrigerating compartment door, and the water tank, the ice making device, and the ice bin may be accommodated into the space. However, in this configuration, since the cool air in the freezing compartment is supplied into the space, the water tank may be disposed in the heat insulation box in the space to prevent the water in the water tank from being frozen.

Figure 12:
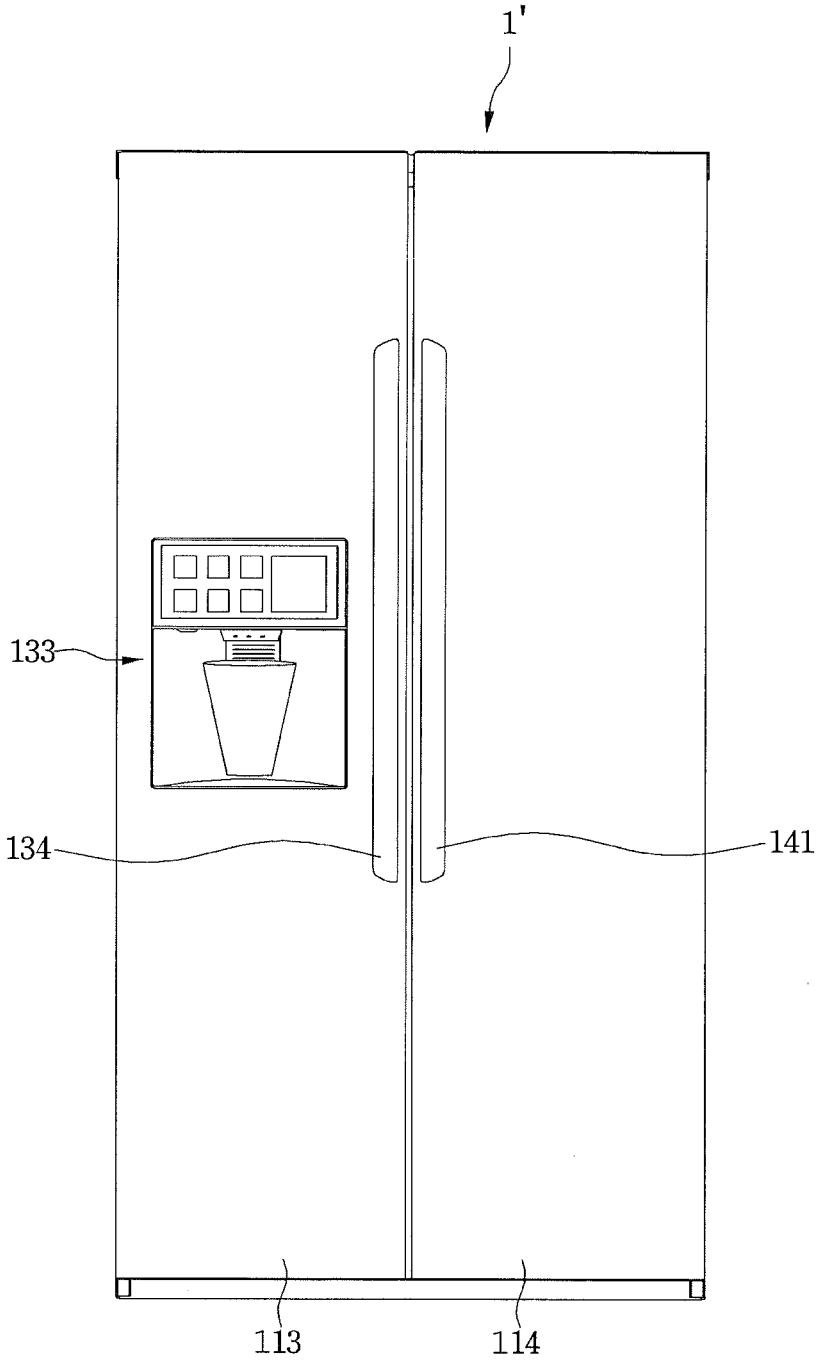
FIG. 12 is a front view showing an example refrigerator according to an implementation.
Figure 13:
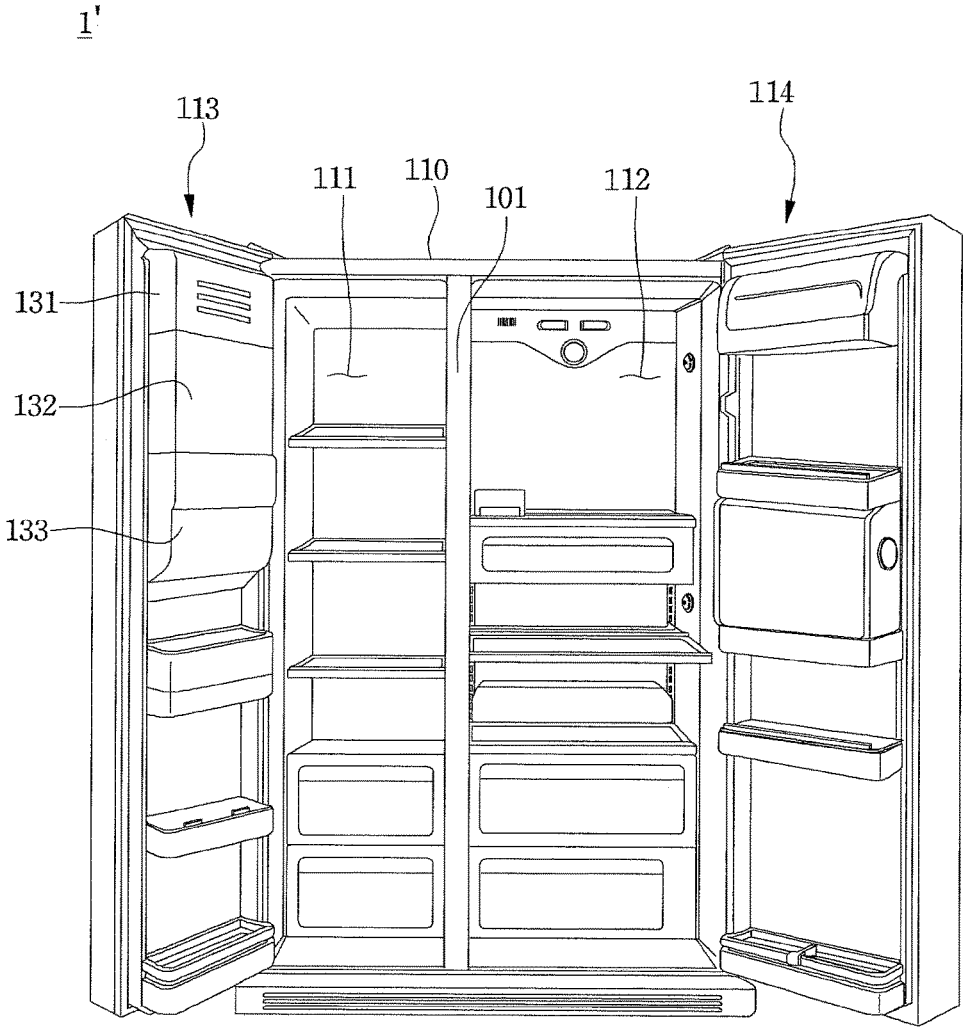
FIG. 13 is a perspective view showing the refrigerator of FIG. 12 in which a door is in an opened state.

FIG. 12 is a front view of a refrigerator according to an implementation, and FIG. 13 is a perspective view of the refrigerator of which a door is in an opened state.

Referring to FIGS. 12 and 13, a refrigerator 1' according to an implementation includes a main body 110 in which the storage compartment is defined therein and doors selectively shielding the storage compartment of the main body 110, similar to what was illustrated in FIG. 1.

The storage compartment may include a freezing compartment 111 and a refrigerating compartment 112. The freezing compartment 111 and the refrigerating compartment 112 may be partitioned into left and right sides by a barrier 101. Of course, when the barrier 101 is horizontally disposed, the freezing compartment 111 and the refrigerating compartment 112 may be partitioned into upper and lower sides as illustrated in FIG. 1.

A plurality of shelves and a plurality of drawers for accommodating food may be provided in the freezing compartment 111 and the refrigerating compartment 112.

Also, the door includes a freezing compartment door 113 and a refrigerating compartment door 114 for respectively shielding the freezing compartment 111 and the refrigerating compartment 112. The freezing compartment door 113 and the refrigerating compartment door 14 may be rotatably mounted on the main body 110 to selectively shield the freezing compartment 111 and the refrigerating compartment 112.

Door handles 134 and 141 may be respectively disposed on front surfaces of the freezing compartment door 113 and the refrigerating compartment door 114. A dispenser 133 may be disposed on the front surface of the freezing compartment door 13. The dispenser 133 may be disposed at one side of the freezing compartment door 113 and refrigerating compartment door 114.

The dispenser 133 is a device for dispensing purified water used as drinking water or ice pieces from the outside. The dispenser 133 may communicate with a portion of an ice making device 120 that will be described later to dispense the ice pieces.

Here, the ice making device 120 may be disposed above the dispenser 133 and be protected by a first cover 131 and a second cover 132 disposed on the freezing compartment door 113.

Figure 14:
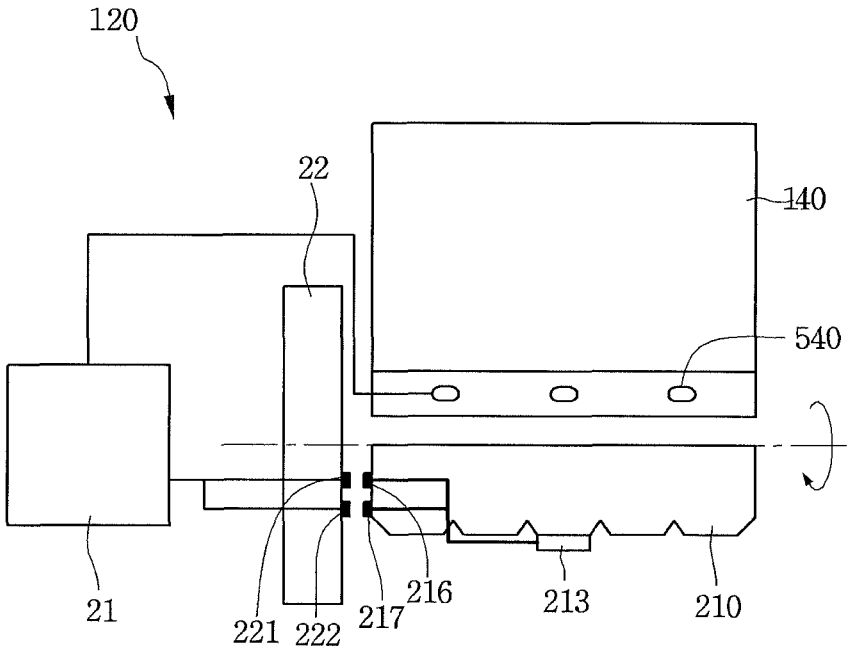
FIG. 14 is a schematic view showing an example ice making device according to an implementation.
Figure 15:
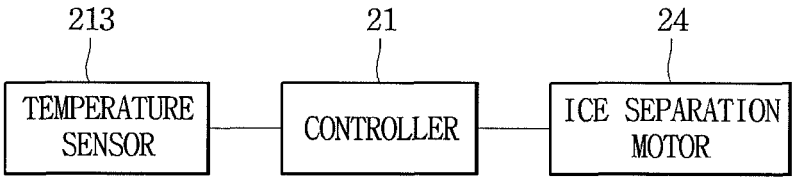
FIG. 15 is a diagram showing a temperature sensor, a controller, and an ice separation motor disposed in the ice making device.

FIG. 14 is a schematic view of an ice making device according to an implementation, and FIG. 15 is control constitutions of a temperature sensor, a controller, and an ice separation motor disposed in the ice making device.

Referring to FIGS. 14 and 15, the ice making device 120 may include an ice making tray 210, a water tank 140, a heater 540, a temperature sensor 213, electrodes 216 and 217, a frame 22, contact points 221 and 222, and a controller 21.

The ice making device 120 may determine whether the water is filled in the water tank 140 by using a principle in which, when water is supplied into the ice making tray 210 from the water tank 140, a surface temperature of the ice making tray 210 increases higher than a freezing temperature due to the water supplied from the water tank 140. Then, the ice making device 20 may determine whether the heater 540 disposed on the water tank 140 operates.

That is, when the surface temperature of the ice making tray 210 reaches a preset temperature, the ice making device 120 determines that the water is filled in the water tank 140 to continuously maintain the operation of the heater 540 disposed on the water tank 140.

Also, when the surface temperature of the ice making tray 210 does not reach a preset temperature, the ice making device 120 rotates again the ice making tray 210 to perform the process for supplying water once again. Nevertheless, when the surface temperature of the ice making tray 210 does not reach the preset temperature, it may be determined that no water exists in the water tank 140. Thus, the operation of the heater 540 disposed on the water tank 140 may be stopped, or the heater 540 may be maintained in a stopped state. Here, the preset temperature represents a temperature higher than the freezing temperature.

Like this, the ice making device 20 may appropriately control an on/off operation of the heater 540 according to whether the water is normally supplied into the ice making tray 210 to minimize power consumed by the heater 540.

Constitutions and operation principles of the constitutions of the ice making device 120 may the same as those of the ice making device 20 illustrated in FIGS. 1 to 11. That is, the ice making tray 210 receives the water from the water tank 140. The water tank 140 may include the water discharge hole. Also, the valve assembly 430 may be disposed on the water discharge hole. The ice making tray 210 operates the valve while rotating at an angle of about 360° by an ice separation motor 24 to allow the water to be supplied into the ice making tray 210. The ice separation motor 24 may be the AC motor rotating in a single direction that is described in the descriptions with respect to FIGS. 1 to 11.

The heater 540 may heat the water tank 140 to prevent the water in the water tank 140 from being frozen. Also, the heater 540 may be stopped when no water is exists in a water container of the water tank 140 so as to minimize an amount of power consumption.

The ice making device 120 may determine whether the water exists in the water container of the water tank 140 by determining whether the water is normally supplied into the ice making tray 210 after the ice piece generated in the ice making tray 210 is separated.

Also, the ice making device 120 may determine whether the water is normally supplied into the ice making tray 210 by detecting whether the surface temperature of the ice making tray 210 rises by using the temperature sensor 213 mounted on the ice making tray 210.

The temperature sensor 213 may be disposed on a bottom surface of the ice making tray 210. However, the present disclosure is not limited to a position of the temperature sensor 213. For example, the temperature sensor 213 may be disposed between the bottom surface and a top surface of the ice making tray 210.

The temperature sensor 213 disposed on the ice making tray 210 may be electrically connected to the controller 21. Thus, surface temperature information of the ice making tray 210 measured by the temperature sensor 213 may be transmitted to the controller 21.

The electrodes 216 and 217 may include a first electrode 216 and a second electrode 217 that are fixed to a side surface of the ice making tray 210. The contact points 221 and 222 may include a first contact point 221 contacting the first electrode 216 and a second contact point 222 contacting the second electrode 217.

Each of the first and second electrodes 216 and 217 may be electrically connected to the temperature sensor 213 and fixed to the side surface of the ice making tray 210.

Also, the first and second contact points 221 and 222 electrically connected to the controller 21 may be fixed to the frame 22 to which the ice making tray 210 rotatably coupled.

Here, for example, the frame 22 may correspond to the tray support 274 constituting the ice making device 20 described in FIG. 4. That is, the first and second contact points 221 and 222 may be disposed on a side surface of the tray support on which the shaft coupling unit 275 is disposed. In detail, the first and second contact points 221 and 222 may be disposed at a position that is spaced a predetermined distance apart from the shaft coupling unit 275.

Also, the first and second electrodes 216 and 217 may be disposed on an end of the valve operation unit 230. In detail, the first and second electrodes 216 and 217 may be disposed on an end of the cam 231 contacting the tray support 274.

More particularly, the first and second contact points 221 and 222 may be disposed on the tray support 274 along a circumference corresponding to rotation trace of the first and second electrodes 216 and 217. Also, the shaft coupling unit 275 may be a center of the circumference corresponding to the rotation trace of the first and second electrodes 216 and 217.

Also, the first and second contact points 221 and 222 may be recessed in a predetermined depth from the frame 22 (or a surface of the tray support 274). Also, the first and second electrodes 216 and 217 may protrude from the side surface of the ice making tray 210 (or the end of the cam 231). This is done to increase a contact degree between the contact points 221 and 222 and the electrodes 216 and 217.

The first and second contact points 221 and 222 may be respectively in contact with the first and second electrodes 216 and 217 at predetermined positions according to the rotation of the ice making tray 210.

Figure 16:
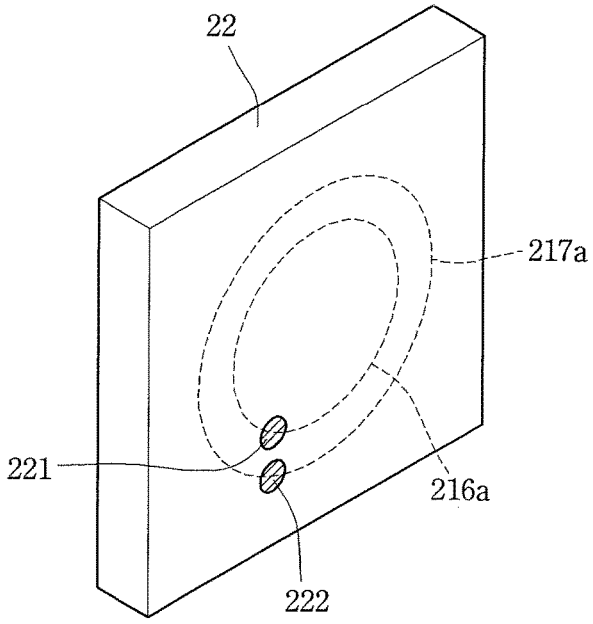
FIG. 16 is a perspective view showing an example shape of a contact point disposed on a frame of the ice making device.

FIG. 16 is a view illustrating a shape of a contact point disposed on a frame of the ice making device.

Referring to FIG. 16, the first and second contact points 221 and 222 may be respectively disposed at a predetermined position on a movement path 216*a* of the first electrode 216 and a predetermined position on a movement path 217*a* of the second electrode 217 when the ice making tray 210 rotates. As illustrated, when the first and second contact points 221 and 222 are disposed at a predetermined position on the movement path 216*a* of the first electrode 216 and a predetermined position on the movement path 217*a* of the second electrode 217, information of the temperature sensor 213 may be transmitted to the controller 21 from the temperature sensor 213 when the first contact point 221 contacts the first electrode 216, and the second contact point 222 contacts the second electrode 217.

Figure 17:
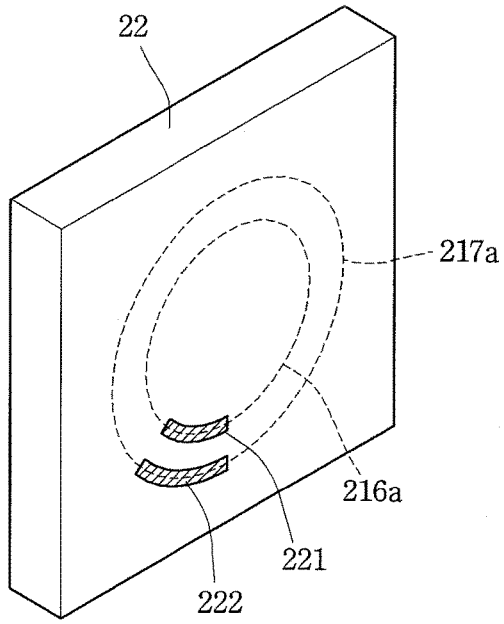
FIGS. 17 to 19 are perspective views showing example shapes of a contact point disposed on a frame of an ice making device according to another implementation.
Figure 19:
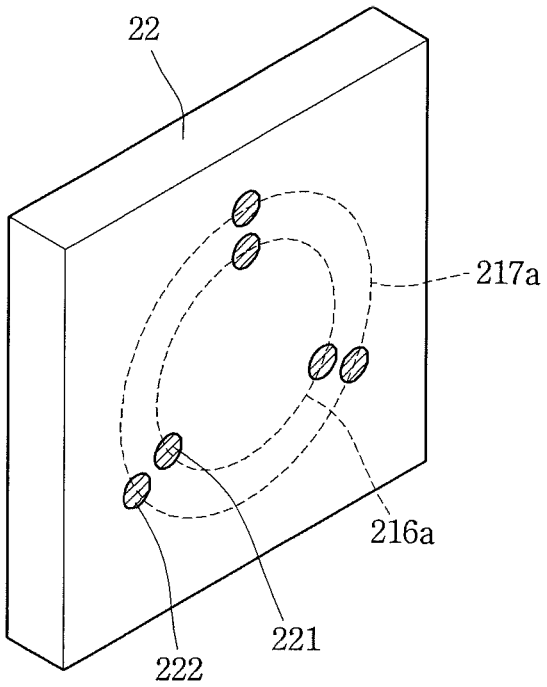

FIGS. 17 and 19 are views of a shape of a contact point disposed on a frame of an ice making device according to another implementation.

Referring to FIG. 17, the first and second contact points 221 and 222 may have arc shapes and disposed in a predetermined section on the movement path 216*a* of the first electrode 216 and in a predetermined section on the movement path 217*a* of the second electrode 217.

Figure 18:
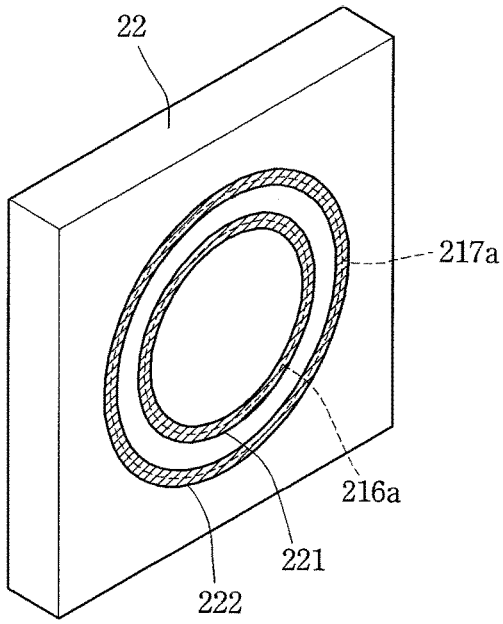

Referring to FIG. 18, the first and second contact points 221 and 222 may be disposed over a whole section on the movement path 216*a* of the first electrode 216 and over a whole section on the movement path 217*a* of the second electrode 217.

Referring to FIG. 19, the first and second contact points 221 and 222 may be disposed at a plurality of positions on the movement path 216*a* of the first electrode 216 and a plurality of positions on the movement path 217*a* of the second electrode 217.

The controller 21 may be electrically connected to the first and second contact points 221 and 222 to block power that is selectively supplied into the heater 540 according to the temperature of the ice making tray 210.

That is, since the ice making device 20 has the electrodes 216 and 217 and the contact points 221 and 222 on portions on which the temperature sensor 213 is electrically connected to the controller 21, there is no risk in damaging or twisting of an electric wire even though the ice making tray 210 rotates.

Hereinafter, a method of controlling the refrigerator for turning on/off the heater 540 will be described in detail.

Figure 20:
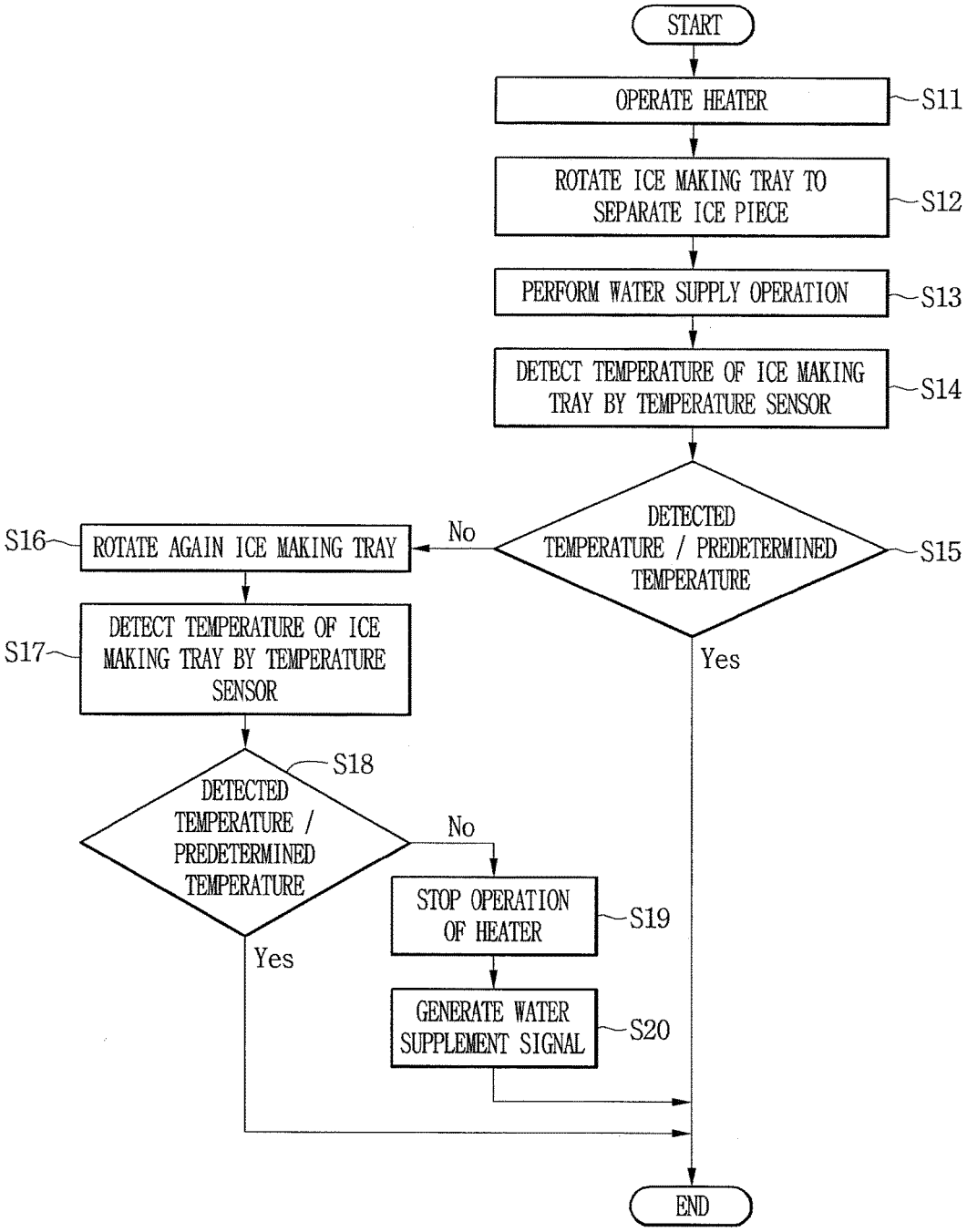
FIG. 20 is a flowchart showing an example method of controlling the refrigerator according to an implementation.

FIG. 20 is a flowchart illustrating a method of controlling the refrigerator according to an implementation.

Referring to FIG. 20, in operation S11, a state in which the heater 540 mounted on the surface of the water tank 140 may be maintained at a turn-on state, and thus the water stored in the water tank 140 is maintained in a liquid state without being frozen may be defined as a basic state.

Then, in operation S12, when the ice piece is completely made, the ice making tray 210 rotates to separate the ice piece therefrom. In operation S13, after the ice piece is separated from the ice making tray 210, the ice making tray 210 further rotates at a predetermined angle, and when the ice making tray 210 reaches a position for receiving water from the water tank 140, a water supply operation is performed. Then, in operation S14, when the water is completely supplied, a temperature of the ice making tray 210 is detected by the temperature sensor 213.

That is, after the ice piece is separated from the ice making tray 210, the water discharge unit of the water tank 140 is opened to complete the supply of the water, and then the temperature of the ice making tray 210 may be measured by the temperature sensor 213. Here, a time point at which a temperature of the ice making tray 210 is measured by the temperature sensor 213 may be a time point right after the water is completely supplied as illustrated in FIG. 7*b*, or at which the ice making tray 210 rotates until the ice making operation starts after the water is completely supplied as illustrated in FIG. 7*c*.

When the temperature measured by the temperature sensor 213 reaches a preset temperature, it may be determined that water exists in the water tank 140, and thus the operation of the heater 540 is continuously maintained. That is, if the water exists in the water tank 140, when the water is supplied into the ice making tray 210 from the water tank 140, the ice making tray 210 may increase in temperature. Thus, the temperature measured by the temperature sensor 213 may be changed from a freezing temperature into a preset temperature that is higher than the freezing temperature.

If a temperature measured by the temperature sensor 213 does not reach a preset temperature, in operation S16, the ice making tray 210 further rotates once again to repeat the water supply operation. Then, in operation S17, a temperature of the ice making tray 210 is detected again by the temperature sensor 213. In operation S18, it may be detected again whether the temperature of the ice making tray 210 reaches a preset temperature. Also, when it is determined that the temperature of the ice making tray 210 reaches a temperature higher than the preset temperature, the water may be normally supplied. Thus, it is determined that the water exists in the water tank 140, and thus the control process is completed.

In detail, a case in which after the ice making tray 210 rotates to separate the ice piece therefrom, the water is not supplied into the ice making tray 210 from the water tank 140 due to malfunction of the water tank 140 may occur. In this case, the water supply operation may be performed again to determine whether the water tank 140 is empty or it is simple malfunction of the water tank 140.

When a temperature of the ice making tray 210 does not reach a preset temperature even though the water supply operation is performed again, in operation S19, it is determined that no water exists in the water tank 140, and the operation of the heater 540 is stopped. In some cases, when the operation of the heater 540 is stopped, an alarm signal for notifying water replenish may be generated at the same time.

Through the above processes, it may be determined whether the heater 540 operates by determining whether the water exists in the water tank 140 to reduce power consumption.

According to the refrigerator and method of controlling the refrigerator according to the implementations, there are effects as follows.

First, in the ice making assembly according to the implementation, the water tank including the valve for opening and closing the water discharge hole may be disposed above the ice making tray. Here, the rotation force of the ice making tray may be transmitted to the valve through the valve operation unit to operate the valve. As a result, the water stored in the water tank may be freely fallen and thus be supplied into the ice making tray without the pump for supplying the water and the electronic valve for adjusting the flow rate. Thus, since it is unnecessary to use the pump and the electronic valve, cost for manufacturing the refrigerator may be reduced. Furthermore, the control program for controlling the pump and the electronic valve may be unnecessary.

Second, the ice making chamber may have the width that gradually decreases from one side to the other side thereof, and the arm of the ejector may firstly contact the portion of the ice, which has the relatively narrow width, separated from the ice making tray while the ice making tray rotates to press the ice piece to be separated. Thus, even though the inexpensive AC motor is used, the ice piece may be easily separated from the ice making tray. Also, since the tray has to rotate in only one direction, the motor rotating in the single direction may be used to reduce the manufacturing costs.

Third, since the elastic member disposed in the valve does not contact the water, the rusting of the elastic member may be prevented to improve sanitation of the water tank.

Fourth, even though the ice making tray rotates, the electrically connected portion of the temperature sensor may not interfere with the ice making tray.

Fifth, the heater disposed on the water tank may be efficiently controlled in operation to minimize power consumption due to the operation of the heater.

Sixth, since the operation of the heater is stopped in a state where no water exists in the water tank, the phenomenon in which the water tank is overheated may be prevented. Also, the malfunction or the breakdown of the refrigerator may be prevented.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body defining a storage compartment;

a door configured to open and close at least a portion of the storage compartment;

an ice making device disposed in the storage compartment or on a back surface of the door;

a water tank disposed above the ice making device and configured to supply water for making ice pieces into the ice making device; and an ice bin disposed under the ice making device to receive and store ice pieces made in the ice making device, wherein the ice making device comprises:

an ice making tray comprising a plurality of ice making chambers that are configured to be filled with water for making the ice pieces, and an ejector extending from an upper central portion of the ice making tray in a longitudinal direction of the ice making tray to pass through both ends of the ice making tray, wherein the ejector is configured to be maintained in a fixed state during water supply, ice making, and ice separation processes, wherein the ice making tray is configured to rotate at an angle of about 360° in one direction with respect to the ejector, and wherein the ejector comprises:

a fixing shaft passing through both ends of the ice making tray, and a plurality of arms that radially extend from an outer circumferential surface of the fixing shaft, wherein, based on the ice making tray rotating, the plurality of arms are configured to press the ice pieces generated in the ice making chambers to eject the ice pieces from the ice making tray, wherein the water tank comprises:

a water discharge hole defined in a bottom surface thereof, and a valve configured to open and close the water discharge hole, wherein the ice making tray further comprises:

a first rotation shaft extending from one side surface thereof, and a second rotation shaft extending from the other side surface opposite to the one side surface, and wherein the refrigerator further comprises:

a driving unit connected to the first rotation shaft, a valve operation unit fitted into an outer circumferential surface of the second rotation shaft to integrally rotate with the ice making tray, and an operation member having a first end that is in contact with an outer circumferential surface of the valve operation unit and a second end that is connected to the valve, the operation member being configured to convert a rotation force of the valve operation unit into linear reciprocating movement to operate the valve.

2. The refrigerator according to claim 1, wherein the plurality of arms are spirally disposed to be spaced a predetermined distance from each other on the outer circumferential surface of the fixing shaft in a longitudinal direction so that the ice pieces made in the ice making chambers are successively separated by a corresponding time difference.

3. The refrigerator according to claim 1, wherein an edge of a top surface of each of the ice pieces being pressed by the arm has a width less than that of an opposite edge of the top surface of each of the ice pieces.

4. The refrigerator according to claim 1, wherein the valve operation unit has one side having a cam shape protruding in a radial direction to elevate the operation member when the cam rotates.

5. The refrigerator according to claim 1, wherein the driving unit comprises:

an alternating current (AC) motor configured to rotate in at least one direction; and a power transmission unit configured to transmit a rotation force of the AC motor to the ice making tray, wherein the power transmission unit comprises a gear assembly.

6. The refrigerator according to claim 1, further comprising a tray support for supporting the ice making tray, wherein the tray support comprises:

a shaft coupling unit horizontally protruding from one surface thereof to support the second rotation shaft; and a movement guide extending upward from the other surface thereof to surround at least a portion of the operation member and to thereby guide movement of the operation member.

7. The refrigerator according to claim 6, wherein the fixing shaft has one end that passes through the second rotation shaft and fixedly supported by the shaft coupling unit, and wherein the second rotation shaft is rotatably supported by the shaft coupling unit.

8. The refrigerator according to claim 6, further comprising a tank support configured to support the water tank, wherein the tank support comprises:

a through-hole through which the movement guide passes; and a water guide unit configured to guide the water discharged from the water discharge hole into the ice making tray.

9. The refrigerator according to claim 8, further comprising a heater mounted on the tank support.

10. The refrigerator according to claim 1, wherein the storage compartment comprises a freezing compartment, and wherein the door comprises a freezing compartment door.

11. The refrigerator according to claim 10, wherein the ice making device and the water tank are disposed on the freezing compartment door, and wherein the refrigerator further comprises a heat insulation box disposed on a back surface of the freezing compartment door to accommodate the water tank therein.

12. The refrigerator according to claim 10, wherein the water tank is disposed on an outer top surface of the main body, wherein the ice making device is disposed in the freezing compartment, and wherein the water discharged from the water tank passes through the main body to be supplied into the ice making device.

13. The refrigerator according to claim 6, further comprising:

a temperature sensor mounted on a surface of the ice making tray to detect a temperature of the ice making tray;

electrodes electrically connected to the temperature sensor, the electrodes being disposed on a side surface of the ice making tray facing the tray support;

contact points disposed on the tray support and configured to electrically contact the electrode; and a controller electrically connected to the contact point and configured to receive the temperature value of the ice making tray.

14. The refrigerator according to claim 13, wherein each of the electrodes is disposed on an end of the valve operation unit that is in contact with the tray support, and each of the contact points is disposed on a circumference corresponding to a rotation trace of the electrode.

15. The refrigerator according to claim 14, wherein the contact points are disposed on one or a plurality of points along the circumference.

16. The refrigerator according to claim 14, wherein each of the contact points has an arc shape having a predetermined length along the circumference.

17. The refrigerator according to claim 14, wherein each of the contact points has a circular shape over an entirety of the circumference.

18. The refrigerator according to claim 14, wherein the electrodes comprise:

a first electrode; and a second electrode disposed at a position that is radially spaced apart from the first electrode, wherein the contact points comprise:

a first contact point corresponding to the first electrode, and a second contact point corresponding to the second electrode.

19. The refrigerator according to claim 13, further comprising a heater mounted on the water tank, the heater being configured to be controlled in on/off operation by the controller based on the temperature value detected by the temperature sensor.

* * * * *